US012698908B2

(12) United States Patent
Choi et al.

(10) Patent No.: US 12,698,908 B2
(45) Date of Patent: Aug. 4, 2026

(54) METHOD AND APPARATUS FOR INJECTING WATER TO AN OUTDOOR HEAT EXCHANGER OF AN AIR CONDITIONER

(71) Applicant: Samsung Electronics Co., Ltd., Suwon-si (KR)

(72) Inventors: Kanghee Choi, Suwon-si (KR); Eunjae Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 172 days.

(21) Appl. No.: 18/244,600

(22) Filed: Sep. 11, 2023

(65) Prior Publication Data

US 2024/0068678 A1 Feb. 29, 2024

Related U.S. Application Data

(63) Continuation of application No. PCT/KR2023/012357, filed on Aug. 21, 2023.

(30) Foreign Application Priority Data

Aug. 25, 2022 (KR) ..... 10-2022-0107181
Oct. 28, 2022 (KR) ..... 10-2022-0141758

(51) Int. Cl.
*F24F 1/42* (2011.01)
*F24F 11/70* (2018.01)
(Continued)

(52) U.S. Cl.
CPC ..... *F24F 1/42* (2013.01); *F24F 11/70* (2018.01); *F24F 13/222* (2013.01);
(Continued)

(58) Field of Classification Search
CPC ..... F25B 2700/171; F25B 2700/172; F25B 1/039; F25B 1/42; F25B 2013/225; F25B 2013/227
See application file for complete search history.

(56) References Cited

U.S. PATENT DOCUMENTS 10,251,316 B1 * 4/2019 Nachefski ..... F24F 11/47
10,921,000 B2 * 2/2021 Chitrala ..... F03D 7/0276
(Continued)

FOREIGN PATENT DOCUMENTS

CN 111895497 A 11/2020
EP 3696934 A1 * 8/2020 ..... F24F 11/46
(Continued)

OTHER PUBLICATIONS

Inject Definition & Meaning, Merriam-Webster Online Dictionary, retrieved from https://www.merriam-webster.com/dictionary/inject on Apr. 16, 2025.*
(Continued)

*Primary Examiner* — Jerry-Daryl Fletcher
*Assistant Examiner* — Daniel C Comings
(74) *Attorney, Agent, or Firm* — STAAS & HALSEY LLP

(57) ABSTRACT

Provided is an air conditioner comprising an outdoor unit comprising an outdoor heat exchanger; and an injection device configured to inject water to the outdoor unit, the injection device including a water tank configured to store water; a nozzle configured to inject the water to the outdoor heat exchanger; a communication interface; a memory storing at least one instruction; and at least one processor configured to: obtain state information of the outdoor unit, wherein the obtained state information includes at least one of condenser operating frequency information or fan revolution per minute information of the outdoor unit, and
(Continued)

control a water injection operation of the nozzle to inject water to the outdoor heat exchanger, in accordance with the at least one of the condenser operating frequency information or the fan revolution per minute (RPM) information of the outdoor unit included in the obtained state information.

19 Claims, 28 Drawing Sheets

(51) Int. Cl.

| | |
|---|---|
| ***F24F 13/22*** | (2006.01) |
| *F24F 110/10* | (2018.01) |
| *F24F 110/20* | (2018.01) |
| *F24F 140/00* | (2018.01) |

(52) U.S. Cl.
CPC ..... *F24F 2110/10* (2018.01); *F24F 2110/20* (2018.01); *F24F 2140/00* (2018.01); *F25B 2700/171* (2013.01)

(56) References Cited

U.S. PATENT DOCUMENTS

| | | | | |
|---|---|---|---|---|
| 2011/0023506 | A1 | 2/2011 | Day et al. | |
| 2011/0048051 | A1* | 3/2011 | Duffy | F28D 5/00 62/305 |
| 2011/0218681 | A1* | 9/2011 | Jung | F24F 11/52 700/276 |
| 2015/0300684 | A1* | 10/2015 | Mehta | F24F 13/24 62/296 |
| 2017/0276443 | A1* | 9/2017 | Bode, III | B05B 13/0421 |
| 2020/0208887 | A1* | 7/2020 | Mohammad | F25B 39/04 |

FOREIGN PATENT DOCUMENTS

| | | | | |
|---|---|---|---|---|
| JP | 2006-162152 | | 6/2006 | |
| JP | 2007-285686 | | 11/2007 | |
| JP | 2013-76538 | | 4/2013 | |
| JP | 2013-119992 | | 6/2013 | |
| JP | 2013-213616 | | 10/2013 | |
| JP | 2015-87065 | | 5/2015 | |
| KR | 2000-0021354 | | 12/2000 | |
| KR | 20-0265904 | | 2/2002 | |
| KR | 10-0454052 | | 10/2004 | |
| KR | 10-0454053 | | 10/2004 | |
| KR | 10-2005-0052739 | | 6/2005 | |
| KR | 10-2005-0110229 | | 11/2005 | |
| KR | 10-0565507 | | 3/2006 | |
| KR | 10-2013-0053752 | | 5/2013 | |
| KR | 10-1541729 | | 8/2015 | |
| KR | 10-1801069 | | 11/2017 | |
| KR | 10-2214539 | | 2/2021 | |
| KR | 10-2224193 | | 3/2021 | |
| WO | WO 2021/149135 | A1 | 7/2021 | |
| WO | WO-2022264308 | A1 * | 12/2022 | F24F 11/871 |

OTHER PUBLICATIONS

International Search Report, PCT/ISA/210, dated Nov. 20, 2023, in PCT Application No. PCT/KR2023/012357.
Written Opinion, PCT/ISA/237, dated Nov. 20, 2023, in PCT Application No. PCT/KR2023/012357.
European Search Report dated Aug. 20, 2025, in European Application No. EP 23 85 7680.

* cited by examiner

FIG. 6
<COMPARISON OF INJECTION CHARACTERISTICS BETWEEN DIFFERENT TYPES OF NOZZLES>
| INJECTION CHARACTERISTICS \ TYPES OF NOZZLES | | TWIN-FLUID | FINE (SINGLE-FLUID) | HOLLOW CIRCULAR (SINGLE-FLUID) | CIRCULAR (SINGLE-FLUID) |
|---|---|---|---|---|---|
| 0.7 bar (10 psi) | CAPACITY l/min | 0.2 ~ 0.8 | 0.83 | 0.19 ~ 45 | 0.38 ~ 45 |
| | VMD μm | 20 ~ 100 | 375 | 360 ~ 3400 | 1140 ~ 4300 |
| | SPRAY PATTERN | 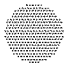 | 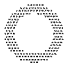 | 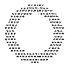 | 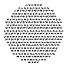 |

FIG. 13

| DEVICE | STATE INFORMATION | WATER INJECTION TIME PERIOD | WATER INJECTION CYCLE |
|---|---|---|---|
| INDOOR UNIT | INDOOR TEMPERATURE/HUMIDITY ↑ | ↑ | ↓ |
| | INDOOR TEMPERATURE/HUMIDITY ↓ | ↓ | ↑ |
| | TARGET TEMPERATURE/HUMIDITY ↑ | ↓ | ↑ |
| | TARGET TEMPERATURE/HUMIDITY ↓ | ↑ | ↓ |
| | INDOOR DEHUMIDIFICATION AMOUNT (CONDENSATE WATER AMOUNT) ↑ | ↑ | ↓ |
| | INDOOR DEHUMIDIFICATION AMOUNT (CONDENSATE WATER AMOUNT) ↓ | ↓ | ↑ |
| OUTDOOR UNIT | COMPRESSOR OPERATING FREQUENCY ↑ | ↑ | ↓ |
| | COMPRESSOR OPERATING FREQUENCY ↓ | ↓ | ↑ |
| | OUTDOOR TEMPERATURE ↑ | ↑ | ↓ |
| | OUTDOOR TEMPERATURE ↓ | ↓ | ↑ |
| | FAN RPM ↑ | ↑ | ↓ |
| | FAN RPM ↓ | ↓ | ↑ |
| INJECTION DEVICE | WATER LEVEL OF WATER TANK ↑ | ↑ | ↓ |
| | WATER LEVEL OF WATER TANK ↓ | ↓ | ↑ |

FIG. 23
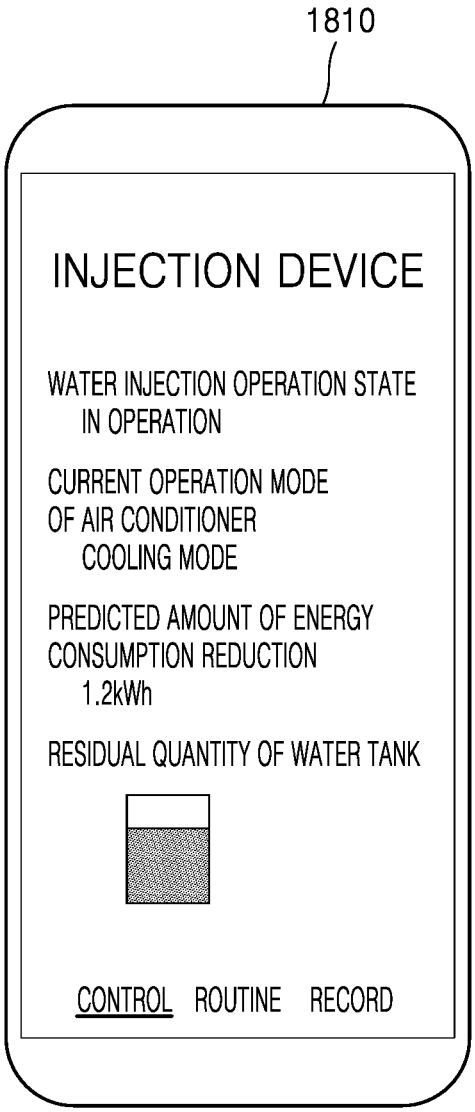
2310
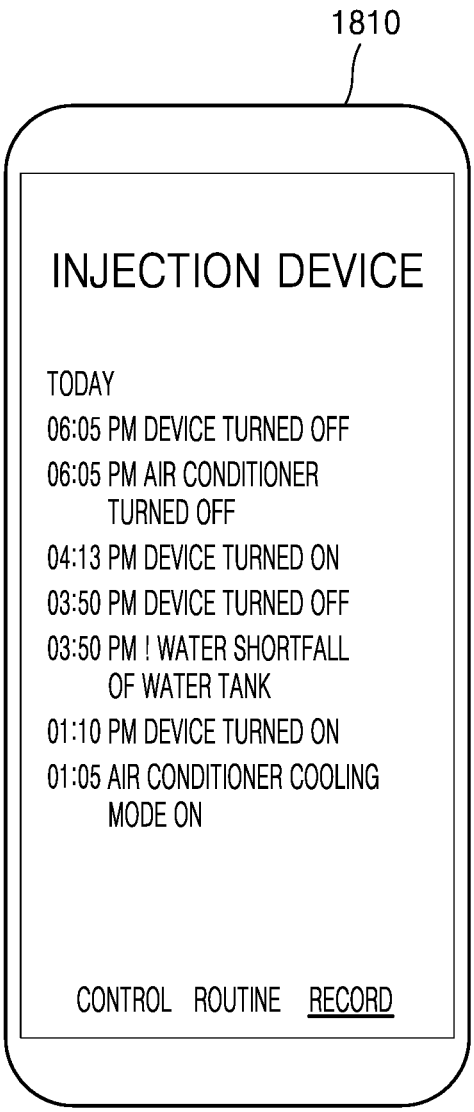
2320

METHOD AND APPARATUS FOR INJECTING WATER TO AN OUTDOOR HEAT EXCHANGER OF AN AIR CONDITIONER

CROSS-REFERENCE TO RELATED APPLICATIONS

This application is a continuation application of international application No. PCT/KR2023/012357, filed on Aug. 21, 2023, which is incorporated herein by reference in its entirety, and which claims priority under 35 U.S.C. § 119 to Korean Patent Application No. 10-2022-0107181, filed on Aug. 25, 2022, and Korean Patent Application No. 10-2022-0141758, filed on Oct. 28, 2022, in the Korean Intellectual Property Office, and which are incorporated herein by reference herein in their entireties.

TECHNICAL FIELD

An embodiment of the disclosure relates to a method and apparatus for improving thermal efficiency of an air conditioner. An embodiment of the disclosure relates to an air conditioner including an outdoor unit. An embodiment of the disclosure relates to a controlling method for an air conditioner including an outdoor unit and a computer-readable recording medium having recorded thereon a program for executing the controlling method for an outdoor unit. An embodiment of the disclosure relates to a controlling method for an electronic device for providing information about the amount of energy consumption reduction according to an outdoor unit.

BACKGROUND ART

An air conditioner includes an indoor unit and an outdoor unit. The outdoor unit of the air conditioner uses an air cooling method that uses wind generated from a fan to decrease a temperature of a heat exchanger of the outdoor unit. The air cooling method facilitates thermal convection and radiation from the heat exchanger. However, when heat exchanging is not appropriately performed due to a shortfall of a heat exchange capacity of the outdoor unit, cooling efficiency and energy efficiency of the air conditioner may be reduced. Therefore, a method and apparatus for improving heat-exchanging efficiency of the outdoor unit is required.

DESCRIPTION OF EMBODIMENTS

Technical Solution to Problem

According to an embodiment of the disclosure, an air conditioner including an outdoor unit is provided. The outdoor unit comprises an outdoor heat exchanger and an injection device which injects water to the outdoor unit. Also, the injection device comprises a water tank configured to store water. Also, the injection device comprises a nozzle configured to inject the water stored in the water tank to the outdoor heat exchanger. Also, the injection device comprises a communication interface. Also, the injection device comprises a memory storing at least one instruction. Also, the injection device comprises at least one processor configured to execute the at least one instruction to: obtain state information of the outdoor unit, wherein the obtained state information includes at least one of compressor operating frequency information or fan revolution per minute (RPM) information of the outdoor unit, and control a water injection operation of the nozzle to inject water to the outdoor heat exchanger, in accordance with the at least one of the compressor operating frequency information or the fan revolution per minute (RPM) information of the outdoor unit included in the obtained state information.

Also, according to an embodiment of the disclosure, there is provided a controlling method for an air conditioner including an outdoor unit. The controlling method comprises obtaining state information of the outdoor unit, wherein the obtained state information includes at least one of compressor operating frequency information or fan revolution per minute (RPM) information of the outdoor unit. Also, the controlling method comprises controlling, in accordance with the at least one of the compressor operating frequency information or the fan revolution per minute (RPM) information of the outdoor unit included in the obtained state information, a water injection operation, performed by a nozzle of the outdoor unit, of injecting water stored in a water tank of the outdoor unit to an outdoor heat exchanger.

Also, according to an embodiment of the disclosure, there is provided a computer-readable recording medium having recorded thereon a program for executing, on a computer, a controlling method for an air conditioner.

Also, according to an embodiment of the disclosure, there is provided a controlling method for an electronic device. The controlling method comprises receiving, from an outdoor unit configured to inject water to an outdoor heat exchanger, operation information of the outdoor unit. Also, the controlling method comprises receiving state information of the outdoor unit. Also, the controlling method comprises calculating, based on the received operation information of the outdoor unit and the received state information of the outdoor unit, information about an amount of energy consumption reduction according to the outdoor unit. Also, the controlling method comprises displaying the received operation information of the outdoor unit. Also, the controlling method comprises displaying the calculated information about the amount of energy consumption reduction according to the outdoor unit.

BRIEF DESCRIPTION OF DRAWINGS

FIG. 6 is a diagram for describing an operation of a nozzle according to an embodiment of the disclosure.

FIG. 13 is a diagram showing a method of controlling a water injection operation according to state information of an indoor unit, state information of an outdoor unit, or state information of an injection device, according to an embodiment of the disclosure.

FIG. 23 is a diagram showing an operation of outputting operation information of an injection device on a user device, according to an embodiment of the disclosure.

MODE OF DISCLOSURE

Figure 1:
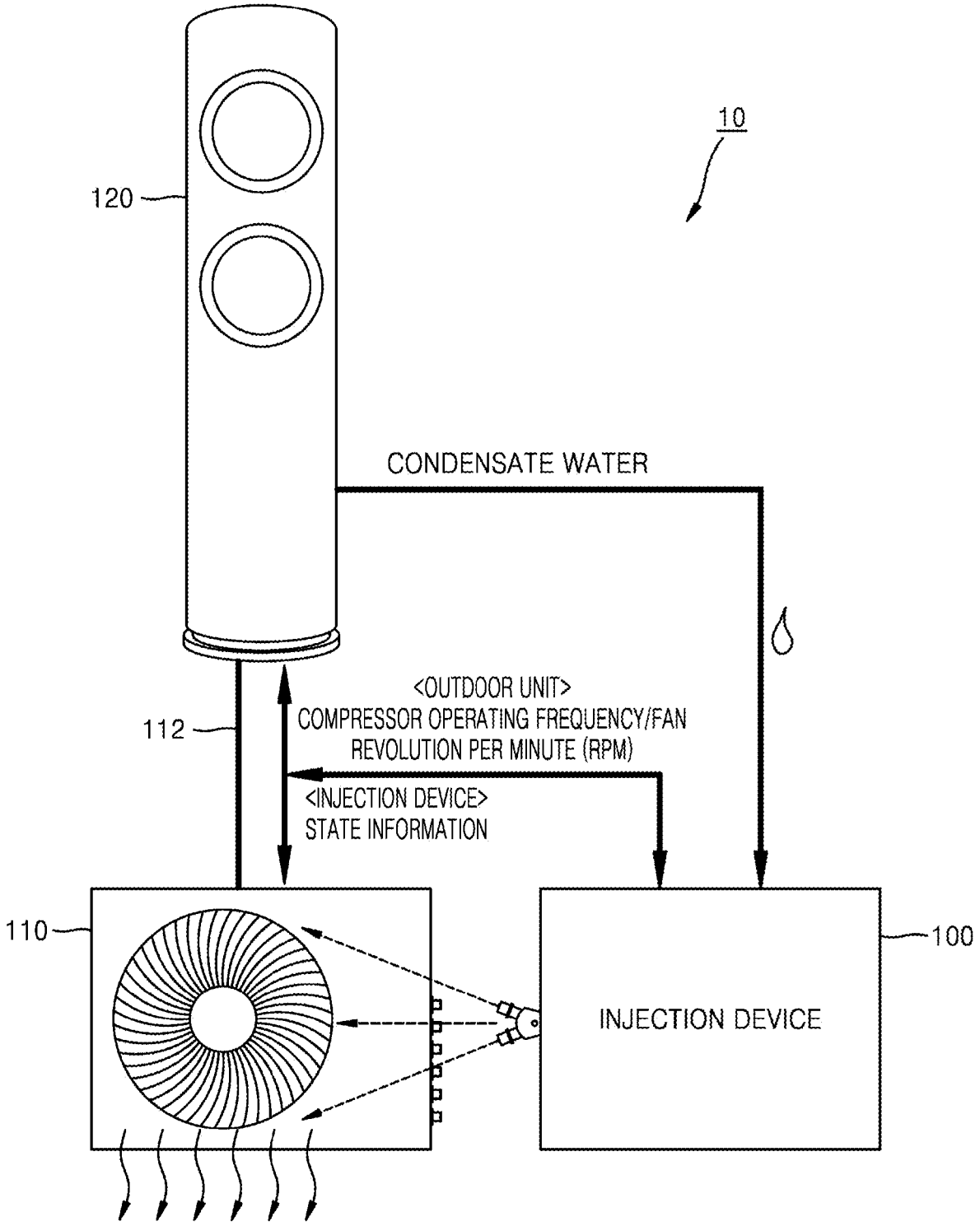
FIG. 1 is a diagram of an air conditioner according to an embodiment of the disclosure.

Various embodiments of the disclosure and terms used herein are not intended to limit the technical features described in this specification to particular embodiments, and it should be understood that various modifications, equivalents, or substitutes of the corresponding embodiments are also included in the technical features.

With regard to the description of the drawings, similar reference numerals may be used for similar or relevant components.

A singular form of a noun corresponding to an item may include a singular number or a plural number of the item, unless apparently otherwise indicated in the context.

In this disclosure, each of expressions such as "A or B," "at least one of A and B," "at least one of A or B," "A, B, or C," "at least one of A, B, and C," and "at least one of A, B, or C" may include any one of items listed together with the corresponding expression or all possible combinations of the same. As an example, the expression "at least one of A or B" may include any of the following: A, B, A and B. As a more specific example, an expression such as "at least one of compressor operating frequency information or fan revolution per minute (RPM) information" may include any of the following: (a) compressor operating frequency information, (b) fan revolution per minute (RPM) information, (c) compressor operating frequency information and fan revolution per minute (RPM) information. As an additional example, the expression "at least one of A, B, or C" may include any of the following: A, B, C, A and B, A and C, B and C, A and B and C.

In this disclosure, the expression "and/or" includes a combination of a plurality of described relevant components or any one of the plurality of described relevant components.

In this disclosure, terms such as "$1^{st}$," "$2^{nd}$," "first," and "second" may be merely used to distinguish a corresponding component from other corresponding components and do not limit the corresponding components in terms of other aspects (for example, the degree of importance or the order).

In this disclosure, when a certain (for example, a first) element is referred to as being "coupled" or "connected" to another (for example, a second) element with the term "functionally" or "communicatively" or without this term, it denotes that the element may be connected to the other element directly (for example, in a wired manner), wirelessly, or through a third element.

In this disclosure, the term "including" or "having" is used to indicate a presence of a feature, a number, a step, an operation, an element, a component, or a combination thereof described herein, and the term does not exclude a presence of one or more other features, numbers, steps, operations, elements, components, or a combination thereof or the possibility of an addition of the same.

When a certain element is referred to as being "connected to," "coupled to," "supported by," or "in contact with" another element, it denotes not only the case where the elements are directly connected to, coupled to, supported by, or in contact with each other, but also the case where the elements are indirectly connected to, coupled to, supported by, or in contact with each other through a third element.

When a certain element is referred to as being "above" another element, it includes not only the case where the element is in contact with the other element, but also the case where yet another element is present between the two components.

Hereinafter, operation principles of an embodiment of the disclosure and various embodiments are described with reference to the accompanying drawings.

FIG. 1 is a diagram of an air conditioner according to an embodiment of the disclosure.

The air conditioner 10 according to an embodiment of the disclosure may include an injection device 100, an outdoor unit 110, and an indoor unit 120.

The air conditioner 10 according to various embodiments of the disclosure may absorb heat in an air-conditioning space (hereinafter, referred to as "an indoor space") and may emit the heat outside the air-conditioning space (hereinafter, referred to as "an outdoor space"), in order to cool the air-conditioning space, which is an object of air conditioning. Also, the air conditioner 10 may absorb heat in the outdoor space and may emit the heat in the indoor space in order to warm the indoor space.

The air conditioner 10 may include one or more outdoor units 110 mounted in the outdoor space and one or more indoor units 120 mounted in the indoor space. The outdoor unit 110 may be electrically connected to the indoor unit 120. For example, a user may input, through a user interface, information (or a command) for controlling the indoor unit 120, and the outdoor unit 110 may operate in response to the user input of the indoor unit 120.

The outdoor unit 110 may be provided in the outdoor space. The outdoor unit 110 may perform a heat exchange between a refrigerant and outdoor air via a phase change (for example, expansion or condensation) of the refrigerant. For example, while the refrigerant is condensed in the outdoor unit 10, the refrigerant may emit heat to the outdoor air. While the refrigerant is expanded in the outdoor unit 110, the refrigerant may absorb heat in the outdoor air.

The indoor unit 120 may be provided in the indoor space. The indoor unit 120 may be provided in the indoor space in various forms. For example, the indoor unit 120 may be implemented as a stand type, a wall-mountable type, a ceiling-mounted system air conditioner, or a home multi-air conditioner. The indoor unit 120 may perform a heat exchange between a refrigerant and indoor air via a phase change (for example, expansion or condensation) of the refrigerant. For example, while the refrigerant is expanded in the indoor unit 120, the refrigerant may absorb heat in the indoor air, and the indoor space may be cooled. While the refrigerant is condensed in the indoor unit 120, the refrigerant may emit heat to the indoor door, and the indoor space may be heated.

The outdoor unit 110 and may be fluidally connected to the indoor unit 120 through a refrigerant pipe 112. Through the refrigerant pipe 112, the refrigerant may be circulated between the outdoor unit 110 and the indoor unit 120. The refrigerant may be circulated among a compressor, an outdoor heat exchanger, and an expansion device of the outdoor unit 110, and an indoor heat exchanger of the indoor unit 120 through the refrigerant pipe 112.

According to an embodiment of the disclosure, the injection device 100 may be mounted or equipped in the outdoor unit 110. The injection device 100 may inject water to an air cooling-type outdoor heat exchanger, and by using vaporization heat by which water adhering to a surface of the heat exchanger is vaporized, may increase cooling efficiency of the outdoor exchanger. Also, by increasing the cooling efficiency of the outdoor heat exchanger, the injection device 100 may reduce the electric charges.

According to an embodiment of the disclosure, the injection device 100, the outdoor unit 110, and the indoor unit 120 may communicate with one another to transmit and receive state information, control information, etc. to and from one another. The outdoor unit 110 and the indoor unit 120 may be connected to each other in a wired manner or a wireless manner through various communication methods. According to an embodiment of the disclosure, the outdoor unit 110 and the indoor unit 120 may be connected to each other through RS-485 serial communication. According to an embodiment of the disclosure, the injection device 100 may be connected to previous RS-485 serial communication used in the outdoor unit 110 and the indoor unit 120.

The injection device 100 may communicate with the outdoor unit 110 and the indoor unit 120 to receive state information output from the outdoor unit 110 and the indoor unit 120. The injection device 100 may receive, from the outdoor unit 110, the state information, such as an operating frequency of a compressor, a revolution per minute (RPM) of a fan, etc. According to an embodiment of the disclosure, the injection device 100 may control a water injection operation of the injection device 100, based on the state information of the outdoor unit 110. When the injection device 100 cyclically or continually injects water regardless of a current operation mode of the air conditioner 10, the injection device 100 may come to inject more or less water than an appropriate amount, and thus, may not efficiently operate. According to embodiments of the disclosure, the injection device 100 may control the water injection operation based on the compressor operating frequency and the fan RPM of the outdoor unit 100. For example, the injection device 100 may adjust a water injection time period or a water injection cycle based on the compressor operating frequency and the fan RPM.

Thus, according to embodiments of the disclosure, by controlling the water injection operation based on the state information of the outdoor unit 110, the injection device 100 may inject an appropriate amount of water to an outdoor heat exchanger, thereby efficiently performing the water injection operation. Also, according to embodiments of the disclosure, by efficiently performing the water injection operation, the injection device 100 may improve heat efficiency of the air conditioner 10 and reduce the electric charges.

Also, according to an embodiment of the disclosure, the injection device 100 may receive condensate water from the indoor unit 120 and use the condensate water for water injection. For the injection device 100 to inject water, a water supply is necessary. When a water supply pipe is connected for the water supply, the construction for connecting the water supply pipe is required, and thus, there is a difficulty in a mounting operation. According to an embodiment of the disclosure, the injection device 100 may receive condensate water through a pipe connected to the indoor unit 120 and use the condensate water for water injection, and thus, the mounting operation may become easy without the need for a construction of an additional water supply pipe.

Figure 2A:
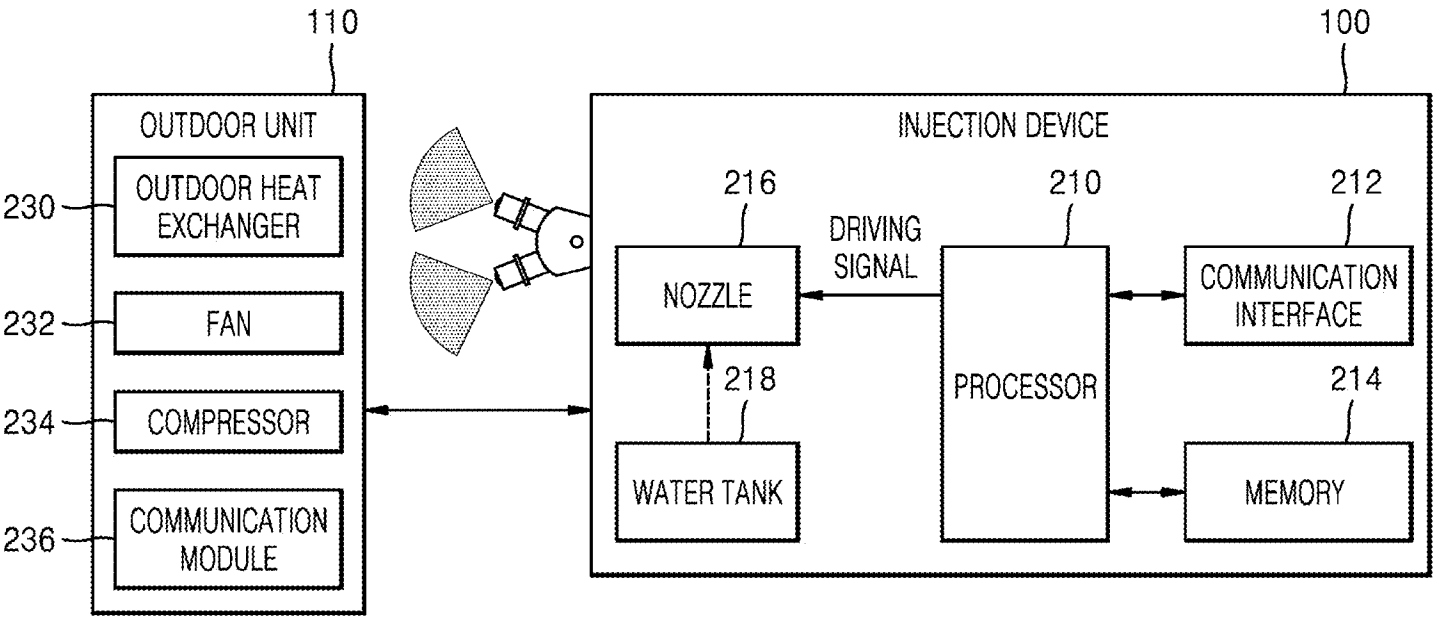
FIG. 2A is a block diagram showing structures of an injection device and an outdoor unit according to an embodiment of the disclosure.

FIG. 2A is a block diagram showing structures of an injection device and an outdoor unit according to an embodiment of the disclosure.

According to an embodiment of the disclosure, the injection device 100 may include a processor 210, a communication interface 212, a memory 214, a nozzle 216, and a water tank 218.

The processor 210 may control general operations of the injection device 100. The processor 210 may be implemented as one or more processors. The processor 210 may perform a predetermined operation by executing an instruction or a command stored in the memory 214. Also, the processor 210 may control operations of the components included in the injection device 100. The processor 210 may include a central processing unit (CPU), a microprocessor, etc.

The communication interface 212 may communicate with the outdoor unit 110 and the indoor unit 120 in a wired or wireless manner. According to an embodiment of the disclosure, the communication interface 212 may communicate with the outdoor unit 110 and the indoor unit 120 by using RS-485 serial communication.

The communication interface 212 may include a wireless communication module (for example, a cellular communication module, a near-field communication module, or a global navigation satellite system (GNSS) communication module) or a wired communication module (for example, a local area network (LAN) communication module or a power line communication module). Also, the communication interface 212 may perform short-range communication and may use, for example, Bluetooth, Bluetooth low energy (BLE), near-field communication, wireless LAN (WLAN) (or Wifi), Zigbee, infrared data association (IrDA) communication, Wifi direct (WFD), ultrawideband (UWB), Ant+ communication, etc. Also, for example, the communication interface 212 may perform remote communication and, for example, may communicate with an external device through a legacy cellular network, a $5^{th}$ generation (5G) network, a next-generation communication network, the Internet, a computer network (for example, a local area network (LAN) or a wide area network (WAN)), or the like.

Also, for example, the communication interface 212 may use mobile communication and may transmit and receive a wireless signal to and from at least one of a base station, an external terminal, or a server on a mobile communication network.

According to an embodiment of the disclosure, the communication interface 212 may be connected to an access point (AP) in a household through Wifi communication. The communication interface 212 may communicate with an external device through the AP.

The memory 214 may store various information, data, instructions, programs, etc. required for an operation of the injection device 100. The memory 214 may include at least one of a volatile memory or a non-volatile memory or a combination thereof. The memory 214 may include at least one type of storage medium from among a flash memory type, a hard disk type, a multimedia card micro type, a card-type memory (e.g., an SD or XD memory), random-access memory (RAM), static RAM (SRAM), read-only memory (ROM), electrically erasable programmable (ROM) (EEPROM), programmable ROM (PROM), a magnetic memory, a magnetic disk, and an optical disk. Also, the memory 214 may correspond to a web storage or a cloud server performing a storage function on the Internet.

According to an embodiment of the disclosure, the injection device 100 may include a microcomputer in which the processor 210, the communication interface 212, and the memory 214 are included as a single chip.

The water tank 218 may store water. The water tank 218 may be implemented in the form of a predetermined container. The water tank 218 may have a water receiver for supplying water and a water discharger for discharging water.

The nozzle 216 may inject water supplied from the water tank 218. The nozzle 216 may include at least one outlet and may inject the water through the outlet. According to an embodiment of the disclosure, the nozzle 216 may be connected to a step motor and may inject the water by reciprocally rotating by a predetermined angle.

The processor 210 may control a water injection operation of the nozzle 216. The processor 210 may control the water injection operation of the nozzle 216 based on outdoor unit state information received from the outdoor unit 110. The outdoor unit state information may include a fan RPM and a compressor operating frequency. The fan RPM is the number of rotations per minute of a fan 232 of the outdoor unit 110. The compressor operating frequency is an operating frequency of a compressor 234 of the outdoor unit 110. The compressor operating frequency may correspond to a frequency of pulse width modulation (PWM) control by a compressor motor. The outdoor unit 110 may cyclically output the RPM of the fan 232 and the compressor operating frequency.

According to an embodiment of the disclosure, the injection device 100, the outdoor unit 110, and the indoor unit 120 may be connected to one another through RS-485 serial communication (hereinafter, referred to as "485 communication"). When the outdoor unit 110 cyclically outputs the fan RPM and the compressor operating frequency through the 485 communication, the indoor unit 120 and the injection device 100 connected to the outdoor unit 110 through the 485 communication may receive the fan RPM and the compressor operating frequency that are output from the outdoor unit 110. A data packet output from the outdoor unit 110 may include transmitter information (that is, the outdoor unit 110) and data (that is, the fan RPM or the compressor operating frequency). The communication interface 212 of the injection device 100 may receive the data packet output from the outdoor unit 110.

When the fan RPM and the compressor operating frequency are received from the outdoor unit 110, the processor 210 may control the water injection operation of the nozzle 216 based on the fan RPM and the compressor operating frequency. The processor 210 may determine a water injection time period and a water injection cycle of the nozzle 216 based on the fan RPM and the compressor operating frequency. The fan RPM and the compressor operating frequency indicate a heat discharge degree of the outdoor unit 110. When the outdoor unit 110 operates at a high heat discharge speed, the amount of heat discharged from an outdoor heat exchanger 230 may be relatively large, and the outdoor heat exchanger 230 may have a high temperature. Thus, as the fan RPM and the compressor operating frequency are increased, the processor 210 may increase the water injection time period of the nozzle 216 and decrease the water injection cycle of the nozzle 216. Also, when the outdoor unit 110 operates at a low heat discharge speed, the amount of heat discharged from the outdoor heat exchanger 230 may be relatively small, and the outdoor heat exchanger 230 may have a low temperature. Thus, as the fan RPM and the compressor operating frequency are decreased, the processor 210 may decrease the water injection time period of the nozzle 216 and increase the water injection cycle of the nozzle 216.

In order to control the water injection time period and the water injection cycle of the nozzle 216, the processor 210 may control operations of a valve to control water discharge from the water tank 218, a step motor for rotating the nozzle 216, etc.

The outdoor unit 110 may include the outdoor heat exchanger 230, the fan 232, the compressor 234, and a communication module 236.

According to an embodiment of the disclosure, the injection device 100 may be coupled to a housing of the outdoor unit 110. The injection device 100 may be implemented in the form of an accessory which may be coupled to the outdoor unit 110. In this case, the injection device 100 may be fixed on an outer wall of the housing of the outdoor unit 110 by a predetermined fixing member. The injection device 100 may be coupled to the outdoor unit 110 such that the water injected from the nozzle 216 may be injected to the outdoor heat exchanger 230. By being coupled to the outdoor unit 110, the injection device 100 may be connected to a predetermined communication terminal provided in the outdoor unit 110 so as to be connected to the 485 communication.

Also, according to an embodiment of the disclosure, the injection device 100 may be equipped in the outdoor unit 110. The injection device 100 may be equipped in the outdoor unit 110 and may inject water to the outdoor heat exchanger 230 of the outdoor unit 110.

The outdoor heat exchanger 230 may perform a heat exchange between a refrigerant and outdoor air. For example, during a cooling operation, a high pressure/high temperature refrigerant may be condensed in the outdoor heat exchanger, and while the refrigerant is condensed, the refrigerant may discharge heat to the outdoor air. During a heating operation, a low temperature/low pressure refrigerant may be expanded in the outdoor heat exchanger, and while the refrigerant is expanded, the refrigerant may absorb heat from the outdoor air.

The fan 232 may be arranged in the vicinity of the outdoor heat exchanger 230. The fan 232 may pass the outdoor air to the outdoor heat exchanger 230 to facilitate the heat exchange between the refrigerant and the outdoor air. The outdoor heat exchanger 230 may use an air-cooling method using the fan 232.

The compressor 234 may condense a refrigerant gas. While the refrigerant gas is condensed by the compressor 234, the refrigerant gas may be transformed from a low temperature/low pressure state to a high temperature/high pressure state.

The communication module 236 may communicate with the injection device 100 and the indoor unit 120 in a wired or wireless manner. According to an embodiment of the disclosure, the communication module 236 may communicate with the injection device 100 and the indoor unit 120 through 485 communication.

The injection device 100 may inject water from the nozzle 216 to the outdoor heat exchanger 230. The water injected to the outdoor heat exchanger 230 may reach a surface of the outdoor heat exchanger 230 and absorb heat and may be suck into the fan 232 and evaporated to the outside of the outdoor unit 110 along with the heat. The evaporation of the water injected to the outdoor heat exchanger 230 may be facilitated by the wind of the fan 232. As the water is evaporated from the outdoor heat exchanger 230, heat-exchange efficiency of the outdoor unit 110 may be increased.

Figure 2B:
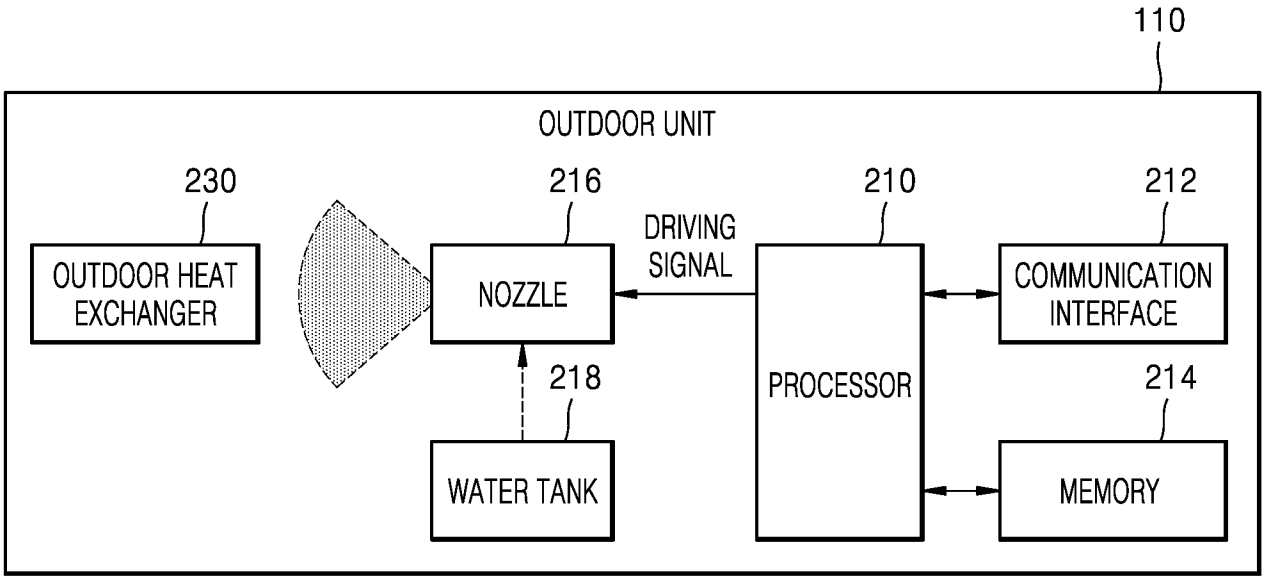
FIG. 2B is a block diagram showing structures of an outdoor unit according to an embodiment of the disclosure.

FIG. 2B is a block diagram showing structures of an outdoor unit according to an embodiment of the disclosure.

According to an embodiment of the disclosure, the outdoor unit 110 may include the processor 210, the communication interface 212, the memory 214, the nozzle 216, the water tank 218, and the outdoor heat exchanger 230.

Figure 3:
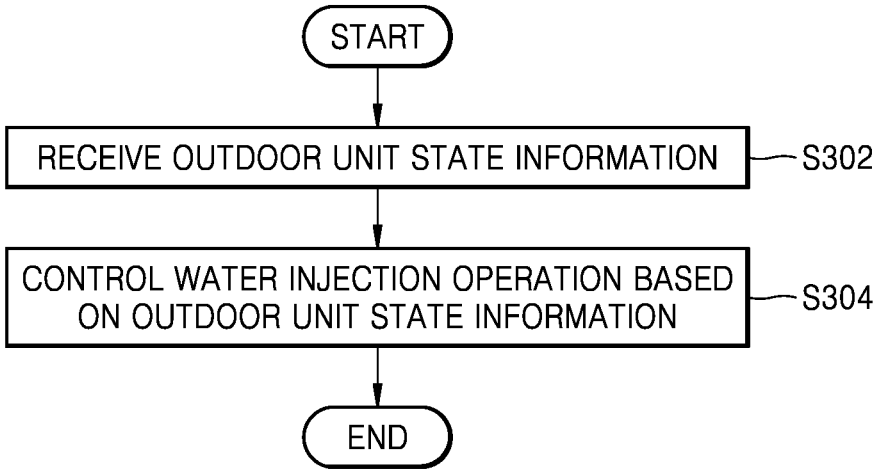
FIG. 3 is a flowchart of a controlling method for an injection device, according to an embodiment of the disclosure.

In the cased that the outdoor unit 110 and the injection device 100 are integrally implemented, a communication operation between the outdoor unit 110 and the injection device 100 may be omitted. Also, in the case that the outdoor unit 110 and the injection device 100 are integrally implemented, an operation that the injection device 100 receives the state information of the outdoor unit 110 may be omitted, and state information of the outdoor unit 110 may be obtained from the outdoor unit 110 itself. Also, in the case that the outdoor unit 110 and the injection device 100 are integrally implemented, an operation that the injection device 100 receives the state information of the indoor unit 120 in the embodiment of FIG. 2A may be changed to an operation that the outdoor unit 110 receives the state information of the indoor unit 120 through the communication interface 212 from the indoor unit 120 in accordance with an embodiment of FIG. 2B. Also, in accordance with an embodiment of 2B, among the operations of the injection device 100 described below, an operation that the injection device 100 receives information from the outdoor unit 110 may be omitted, and the outdoor unit 110 may obtain the information of the outdoor unit 110 itself. Also, in accordance with an embodiment of FIG. 2B, among the operations of the injection device 100 described below, an operation that the injection device 100 receives information from the indoor unit 120 may be changed to an operation that the outdoor unit 110 receives information from the indoor unit 120 through the communication interface 212. Also, in accordance with an embodiment of FIG. 2B, among the operations of the injection device 100 described below, an operation that the injection device 100 transmits information to the outdoor unit 110 may be omitted. Also, in accordance with an embodiment of FIG. 2B, among the operations of the injection device 100 described below, an operation that the injection device 100 transmits information to the indoor unit 120 may be changed to an operation that the outdoor unit 110 transmits information to the indoor unit 120 through the communication interface 212. FIG. 3 is a flowchart of a controlling method for an injection device, according to an embodiment of the disclosure.

The controlling method for the injection device according to an embodiment of the disclosure may be performed by the injection device 100 according to embodiments of the disclosure.

In operation S302, the injection device 100 may receive outdoor unit state information from the outdoor unit 110. The outdoor unit state information may include a fan RPM and a compressor operating frequency. The injection device 100 may cyclically receive the outdoor unit state information from the outdoor unit 110.

Next, in operation S304, the injection device 100 may control a water injection operation of the nozzle based on the outdoor unit state information. The injection device 100 may adjust a water injection time period and a water injection cycle based on the fan RPM and the compressor operating frequency. The injection device 100 may cyclically receive the fan RPM and the compressor operating frequency from the outdoor unit 110 and may adjust the water injection time period and the water injection cycle.

Figure 4:
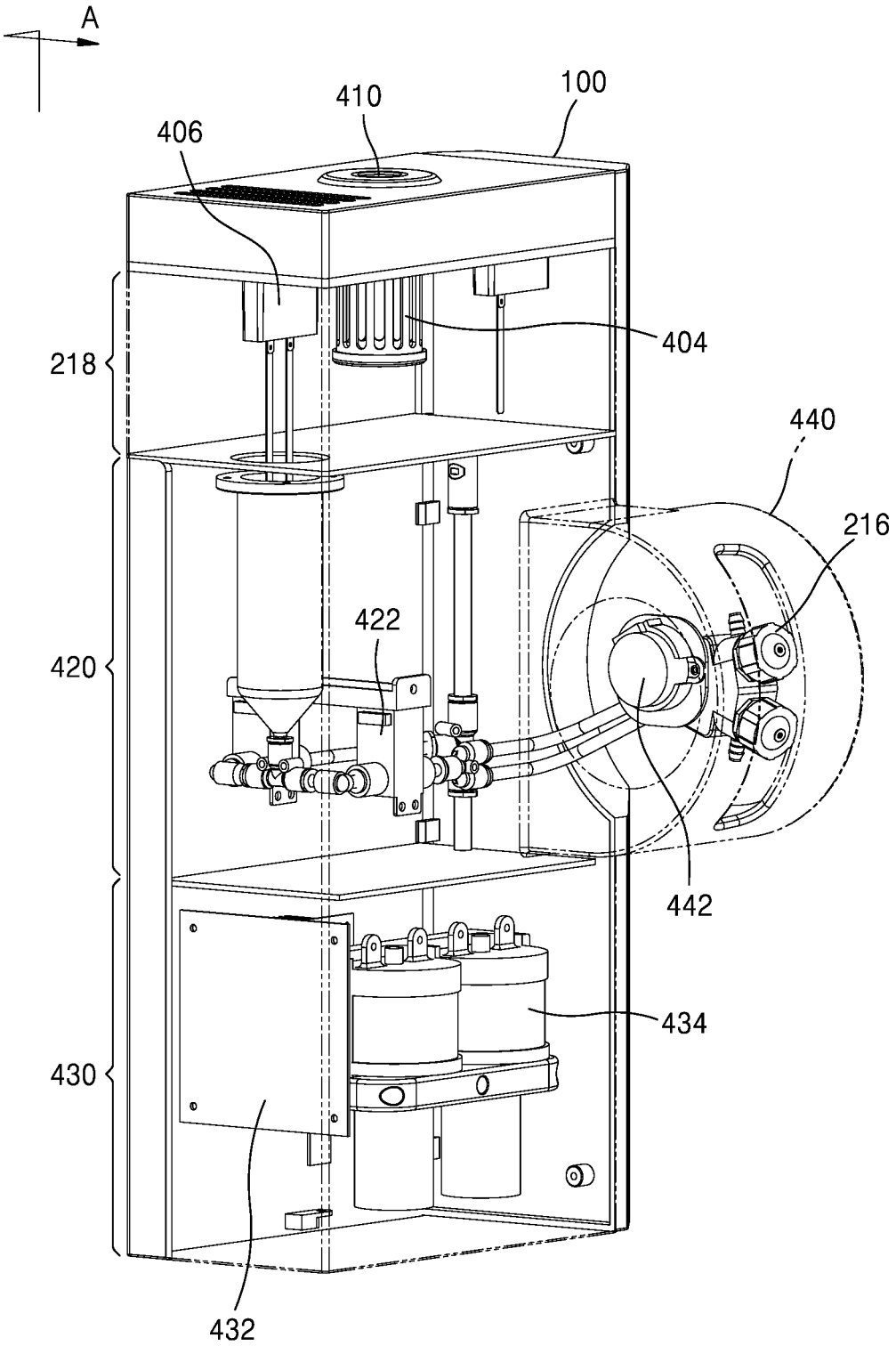
FIG. 4 is a perspective view of an injection device according to an embodiment of the disclosure.

FIG. 4 is a perspective view of an injection device according to an embodiment of the disclosure.

Figure 5:
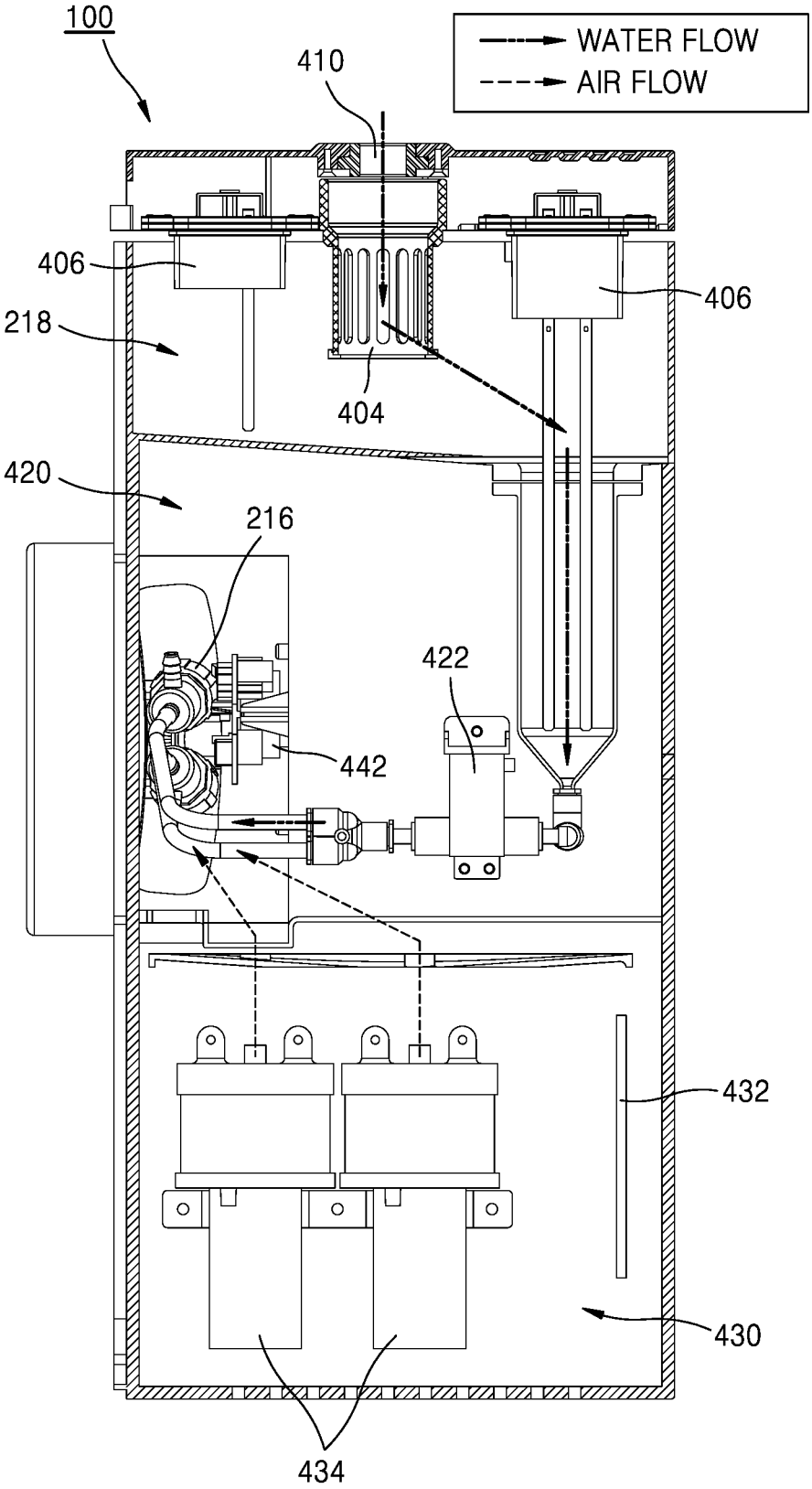
FIG. 5 is a cross-sectional view of an injection device according to an embodiment of the disclosure.

FIG. 5 is a cross-sectional view of an injection device according to an embodiment of the disclosure. FIG. 5 is the cross-sectional view of the injection device of FIG. 4, taken from direction A.

Referring to FIGS. 4 and 5, a structure of the injection device 100 is described.

According to an embodiment of the disclosure, the injection device 100 may include a water receiver 410, the water tank 218, a dispenser 420, a machine room 430, and an outlet 440.

The water receiver 410 may transfer water supplied from the outside to the water tank 218. The water receiver 410 may have an opening and may be coupled to a water-receiving hose. The water receiver 410 may be arranged above the water tank 218. According to an embodiment of the disclosure, the water receiver 410 may be connected to the indoor unit 120 through a hose and may receive condensate water of the indoor unit 120. Also, according to an embodiment of the disclosure, the water receiver 410 may be connected to a water supply through a hose and may receive water from the water supply.

The water tank 218 may store water supplied through the water receiver 410. The water tank 218 may include a container storing water. The water tank 218 may be formed of, for example, a transparent or a semi-transparent material. By forming the water tank 218 by using a transparent or a semi-transparent material, a user may identify, with the naked eye, the residual quantity of the water of the water tank 218 from the outside.

According to an embodiment of the disclosure, the water tank 218 may include a filter 404 and a water-level sensor 406 in the water tank 218. The filter 404 may filter the water supplied through the water receiver 410. The filter 404 may remove impurities of the water supplied through the water receiver 410 and manage the quality of the water stored in the water tank 218. The water-level sensor 406 may measure a water level of the water tank 218. The water-level sensor 406 may output a water-level detection value of the water tank 218 to the processor 210.

The dispenser 420 may receive the water from the water tank 218 and transfer the water to the outlet 440. The dispenser 420 may include a check valve 422. The check valve 422 may adjust the flow of water from the water tank 218 to the outlet 440. Whether to open or close the check valve 422 and a degree of opening of the check valve 422 may be adjusted according to an electronic control signal.

The machine room 430 may include a control module 432 and an air pump 434 in a predetermined space of the machine room 430. The control module 432 may include the processor 210, the communication interface 212, and the memory 214. The control module 430 may correspond to a microcomputer. The air pump 434 may supply air to the nozzle 216 of the outlet 440. An air valve may be provided between the nozzle 216 and the air pump 434. When the air valve is opened while the air pump 434 operates, the water supplied through the check valve 422 may be moved toward the nozzle due to a pressure difference and may be mixed with air and injected.

The check valve 422, the air pump 434, and the air valve may be driven according to a driving signal output from the processor 210. The processor 210 may determine a water injection time period and a water injection cycle based on outdoor unit state information. The processor 210 may determine an opening time period and an opening cycle of the check valve 422, based on the determined water injection time period and water injection cycle. Also, the processor 210 may determine an operation time period and an operation cycle of the air pump 434, based on the determined water injection time period and water injection cycle. Also, the processor 210 may determine an opening time period and an opening cycle of the air valve, based on the determined water injection time period and water injection cycle.

The outlet 440 may inject the water. The outlet 440 may include the nozzle 216 and a step motor 442. The nozzle 216 may include one or more pipes. For example, the nozzle 216 may include two or four pipes. The step motor 442 may rotate the nozzle 216 with respect to a rotation axis. The step motor 442 may drive the nozzle 216 by receiving a driving signal from the processor 210. The processor 210 may set a rotation cycle and a rotation radius of the step motor 442 according to the driving signal.

FIG. 6 is a diagram for describing an operation of a nozzle according to an embodiment of the disclosure.

According to an embodiment of the disclosure, the nozzle 216 may be implemented in the form of a twin-fluid nozzle. The twin-fluid nozzle may minimize a particle size of injected water, by injecting water by mixing the water with air. By injecting the water and the air together, the twin-fluid nozzle may have a long injection distance with a small amount of water. Also, by injecting the water having a fine particle, the twin-fluid nozzle may be advantageous for absorption of evaporation latent heat and may have a high evaporation speed.

FIG. 6 shows the injection characteristics of the twin-fluid nozzle and other types of nozzles, when the twin-fluid nozzle mixes air into water by a pressure of 0.7 bar (10 psi). The types of nozzles compared in FIG. 6 may correspond to a fine single-fluid nozzle, a hollow circular single-fluid nozzle, and a mil circular single-fluid nozzle.

The twin-fluid nozzle may use a less amount of water than the single-fluid nozzle. As illustrated in the table of FIG. 6, the twin-fluid nozzle indicates a significantly less amount of water use particularly compared to the hollow circular single-fluid nozzle and the circular single-fluid nozzle.

Also, the twin-fluid nozzle may have a less volume median diameter (VMD) than the single-fluid nozzle. It may be identified that although the water use amount of the twin-fluid nozzle is similar to the water use amount of the single-fluid nozzle, the VMD of the twin-fluid nozzle is significantly less than a VMD of the fine single-fluid nozzle. Also, the twin-fluid nozzle has a significantly less VMD than the hollow circular single-fluid nozzle and the circular single-fluid nozzle.

Also, the twin-fluid nozzle has a uniform spray pattern. The fine single-fluid nozzle and the hollow circular single-fluid nozzle have decreased spray pattern uniformity. The circular single-fluid nozzle may have a uniform spray pattern, but compared to the twin-fluid nozzle, may have a significantly higher amount of water use and a significantly greater VMD.

Thus, the twin-fluid nozzle may have a less amount of water use and a greater injection distance than the single-fluid nozzle, may inject water having fine particles, and may have a uniform spray pattern. According to an embodiment of the disclosure, the injection device 100 may include the air pump and use the twin-fluid nozzle, and thus, may reduce the amount of water use, increase the water injection distance, and raise the absorption of evaporation latent heat.

Figure 7:
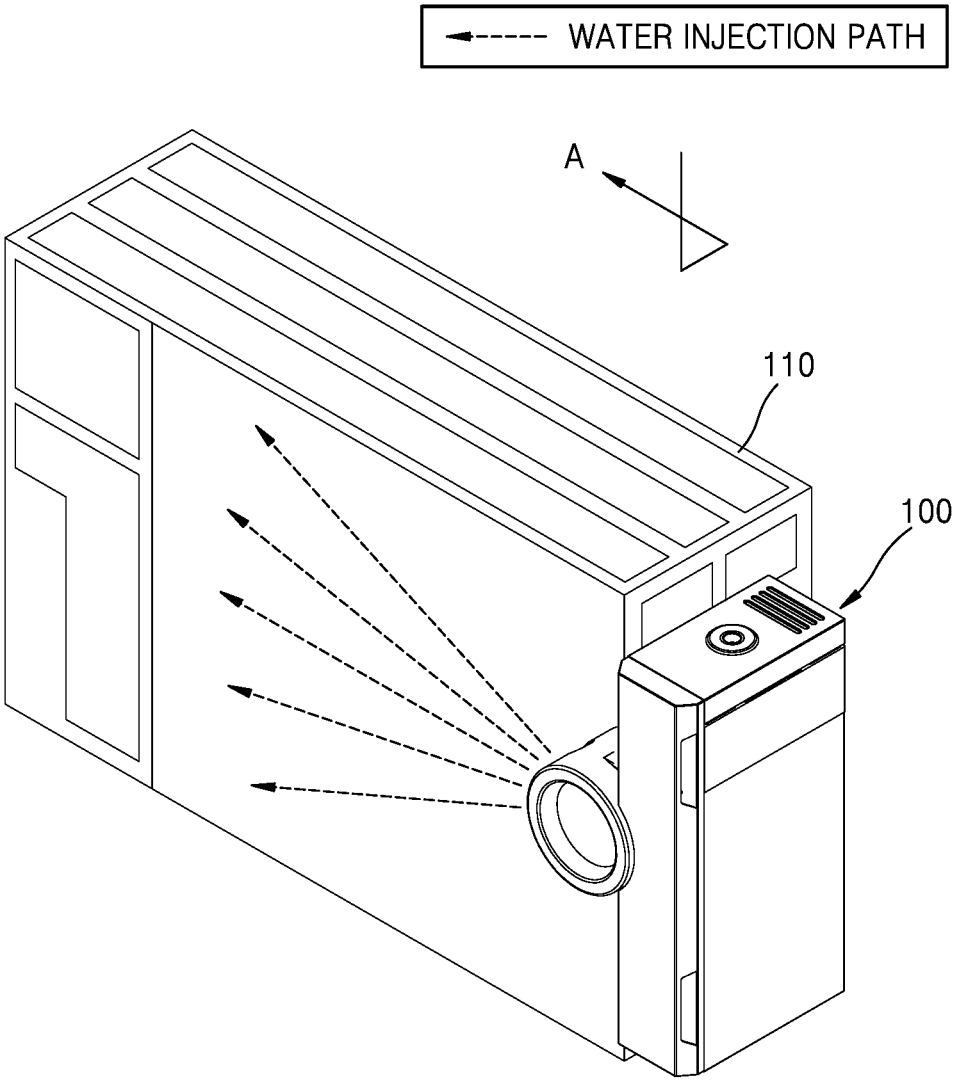
FIG. 7 is a diagram showing a state in which an outdoor unit and an injection device are coupled to each other according to an embodiment of the disclosure.

FIG. 7 is a diagram showing a state in which an outdoor unit and an injection device are coupled to each other, according to an embodiment of the disclosure.

According to an embodiment of the disclosure, the injection device 10 may be coupled to a housing of the outdoor unit 110. The injection device 100 may be arranged such that the nozzle 216 may inject water toward the outdoor heat exchanger 230 of the outdoor unit 110. For example, the injection device 100 may be arranged such that the injection device 100 in direction A of FIG. 4 is coupled to a housing outer wall of the outdoor unit 110.

The nozzle 216 may inject water to the outdoor heat exchanger 230 by being rotated by the step motor 442. As the nozzle 216 injects water by being rotated by the step motor 442, the injection device 100 may evenly inject water throughout the entire area of the outdoor heat exchanger 230.

Figure 8:
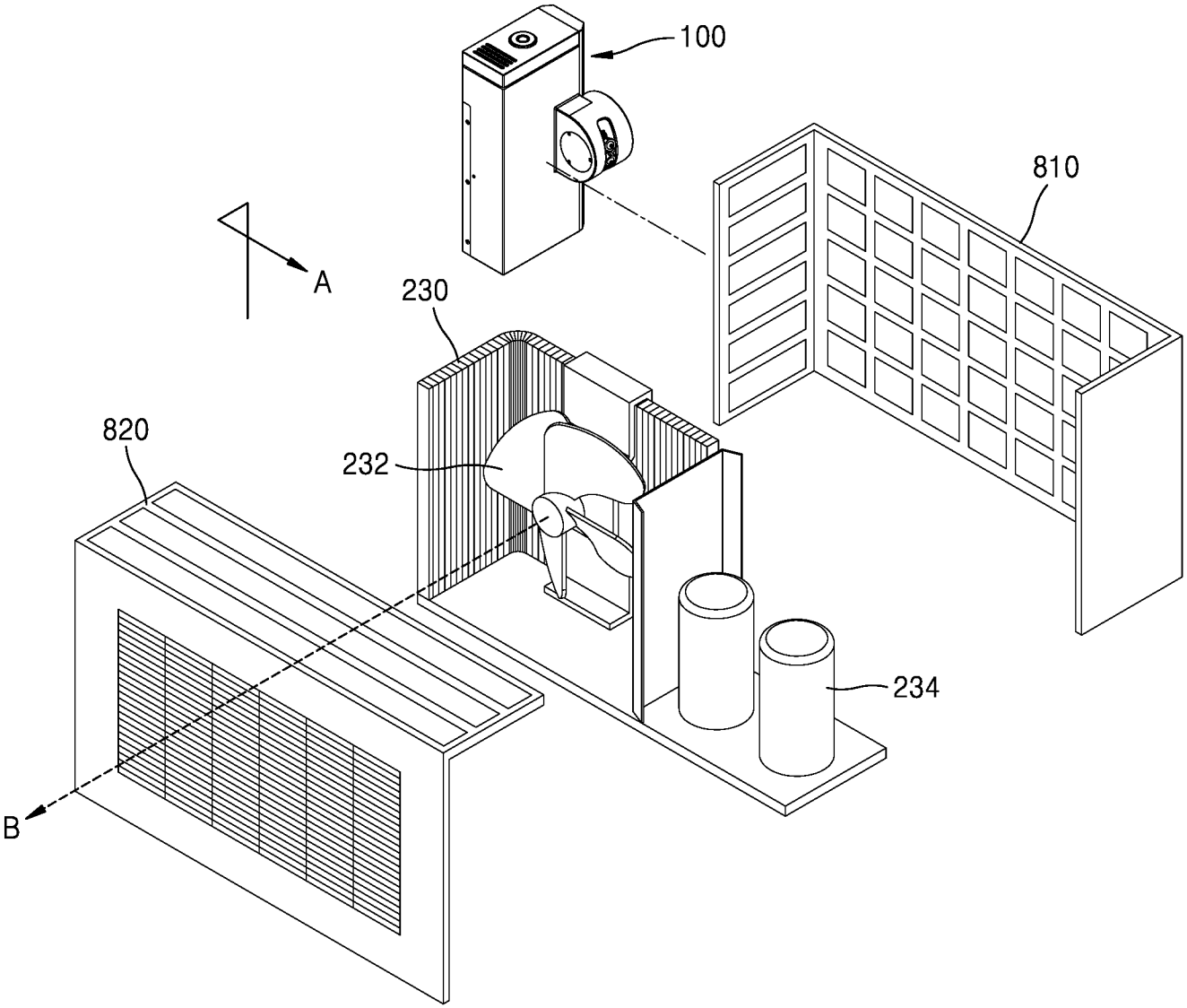
FIG. 8 is a diagram showing structures of an injection device and an outdoor unit according to an embodiment of the disclosure.

FIG. 8 is a diagram showing structures of an injection device and an outdoor unit according to an embodiment of the disclosure.

According to an embodiment of the disclosure, the injection device 10 may be arranged to inject water to the outdoor heat exchanger 230. The outdoor unit 110 may include the outdoor heat exchanger 230, the fan 232, and the compressor 234 in housings 810 and 820. As the fan 232 rotates, an air current may be formed in a front direction B of the outdoor unit 110. Due to the air current generated by the fan 232, heat of the outdoor heat exchanger 230 may be radiated in an air-cooling method.

The injection device 100 may be arranged at side surfaces of the housings 810 and 820 of the outdoor unit 110. For example, the injection device 100 may be arranged at a surface of the rear housing 810 to inject water at a side surface of the outdoor heat exchanger 230 and may be coupled to the rear housing 810. When the water is injected to the outdoor heat exchanger 230 by the injection device 100, the injected water may move in the front direction B of the outdoor unit 110 or evaporated by the air current generated by the fan 232.

Figure 9:
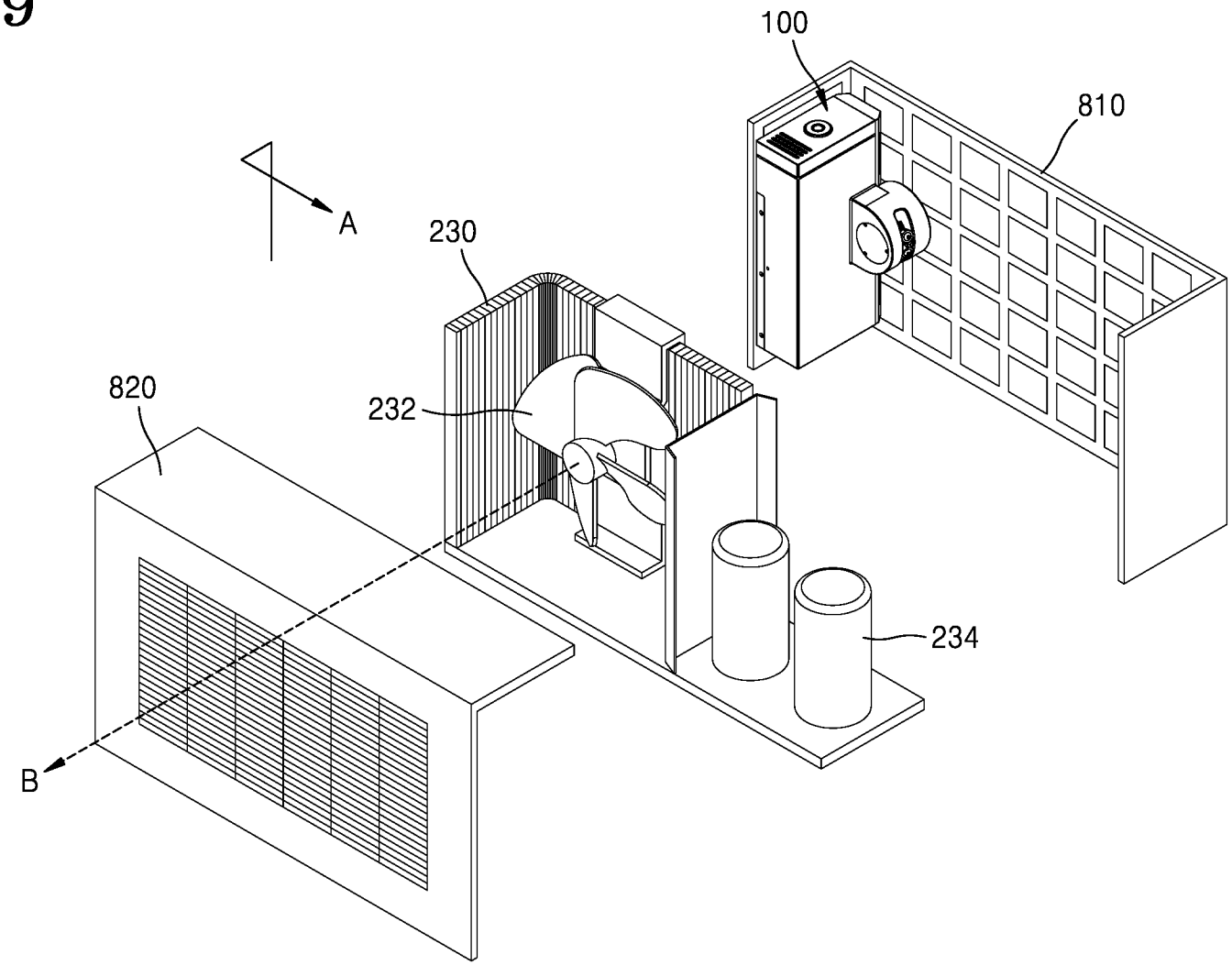
FIG. 9 is a diagram showing structures of an injection device and an outdoor unit according to an embodiment of the disclosure.

FIG. 9 is a diagram showing structures of an injection device and an outdoor unit according to an embodiment of the disclosure.

According to an embodiment of the disclosure, the injection device 100 may be equipped in the outdoor unit 110. The injection device 100 may be arranged at an inner wall of the rear housing 810 and may inject water to the outdoor heat exchanger 230. When the injection device 100 is equipped in the outdoor unit 110, the injection device 100 may be connected to the control module 432 of the outdoor unit 110 to communicate with the outdoor unit 110. The injection device 100 may receive outdoor unit state information from the control module 432 of the outdoor unit 110. Also, the injection device 100 may transmit, to the indoor unit 120, state information of the injection device 100 through the control module 432 of the outdoor unit 110. Also, the injection device 100 may receive power from a power module of the outdoor unit 110.

Figure 10:
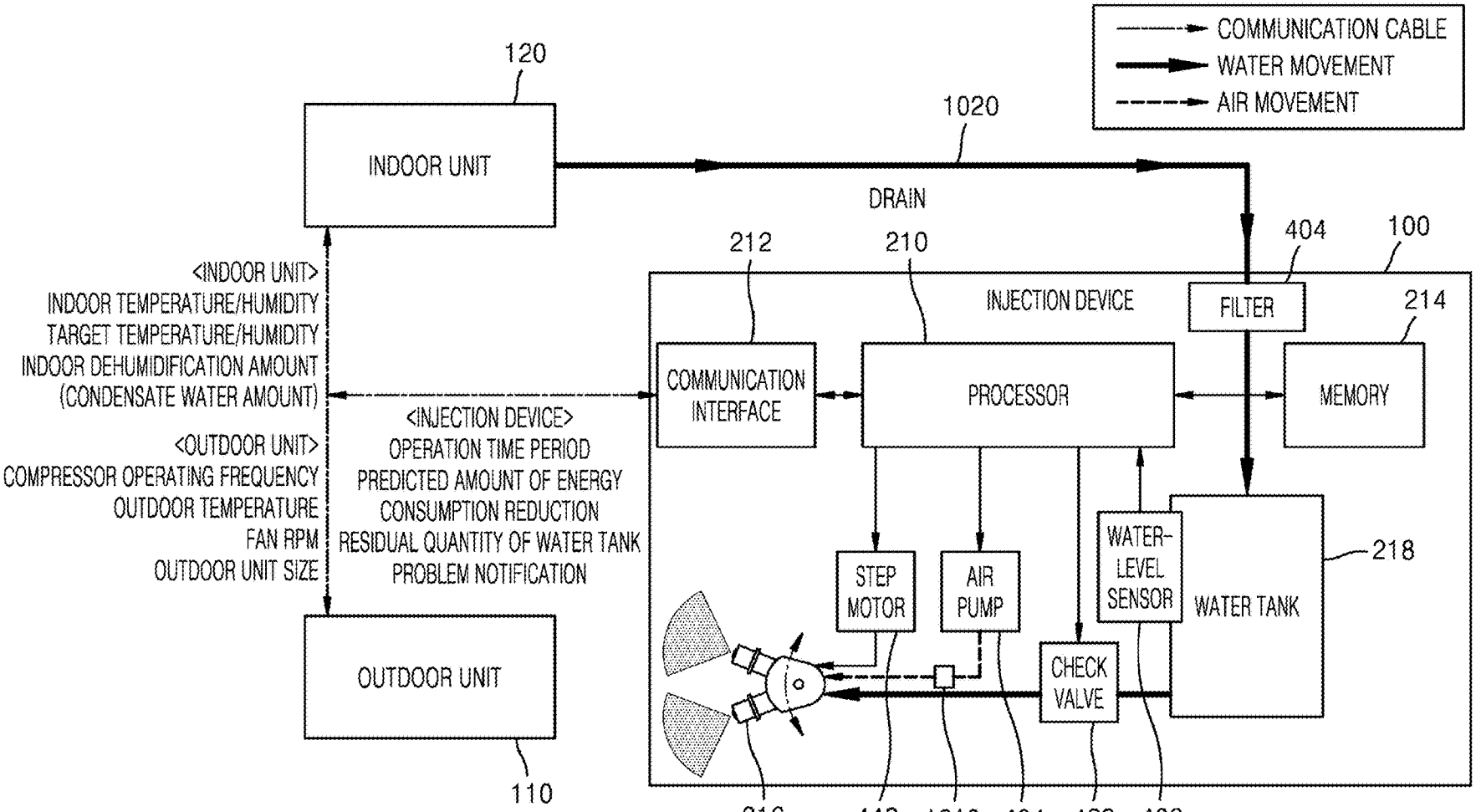
FIG. 10 is a diagram showing a structure of an injection device and a communication operation of an indoor unit, an outdoor unit, and the injection device, according to an embodiment of the disclosure.

FIG. 10 is a diagram showing a structure of an injection device and a communication operation of an indoor unit, an outdoor unit, and the injection device, according to an embodiment of the disclosure.

According to an embodiment of the disclosure, the injection device 100, the outdoor unit 110, and the indoor unit 120 may communicate with one another to transmit and receive state information to and from one another.

According to an embodiment of the disclosure, the state information of the injection device 100 may include at least one of an operation time period, the predicted amount of energy consumption reduction, the residual quantity of the water tank, or problem notification. The operation time period may denote a time period during which the injection device 100 injects water. The predicted amount of energy consumption reduction may be a predicted energy reduction value of the air conditioner 10 according to a water injection operation of the injection device 100. The predicted amount of energy consumption reduction may be calculated by the injection device 100. The residual quantity of the water tank may indicate the amount of remaining water in the water tank 218 of the injection device 100. The residual quantity of the water tank may be measured by the water-level sensor 406. The problem notification may be notification with respect to a case where an error occurs or a case where a predetermined event occurs in the injection device 100. For example, the problem notification may correspond to notification with respect to events, such as a shortfall of water of the water tank 218, a processing error of the processor 210, a communication error, a malfunction of the nozzle, etc.

According to an embodiment of the disclosure, the state information of the outdoor unit 110 may include at least one of a compressor operating frequency, an outdoor temperature, a fan RPM, or an outdoor unit size.

The compressor operating frequency may denote an operating frequency of the compressor 234 of the outdoor unit 110. According to an embodiment of the disclosure, the compressor 234 of the outdoor unit 110 may include a motor including an inverter circuit. The outdoor unit 110 may control the inverter circuit of the compressor 234 according to a PWM control method. The compressor operating frequency may denote a frequency of the PWM control. The outdoor temperature may denote an outdoor temperature measured by the outdoor unit 110. The outdoor unit 210 may include a temperature sensor and may measure the outdoor temperature. The fan RPM may denote an RPM of the fan 232 of the outdoor unit 110. The fan RPM may correspond to an RPM value of a motor driving the fan 232. The outdoor unit size may be a value indicating a size of the outdoor unit 110 and may correspond to a cooling area of the air conditioner, a size of the outdoor heat exchanger 230, or the like.

According to an embodiment of the disclosure, the state information of the indoor unit 120 may include at least one of indoor temperature/humidity, target temperature/humidity, or the indoor dehumidification amount (the amount of condensate water). In this disclosure, the temperature/humidity denotes the temperature or the humidity. That is, the indoor unit state information may include at least one of the indoor temperature, the indoor humidity, the target temperature, the target humidity, or the indoor dehumidification amount. The indoor temperature/humidity may correspond to indoor temperature/humidity measured by the indoor unit 120. The target temperature/humidity may correspond to target temperature/humidity set by a user with respect to the indoor unit 120. The indoor dehumidification amount (the amount of condensate water) may indicate the amount of condensate water collected by the indoor unit 120. The indoor unit 120 may include a condensate water container for collecting the condensate water and may measure the amount of condensate water collected in the condensate water container.

The injection device 100 may receive the outdoor unit state information from the outdoor unit 110 and may control the water injection operation based on the outdoor unit state information. The injection device 100 may control the amount of water injection based on at least one of the compressor operating frequency, the outdoor temperature, or the fan RPM. The amount of water injection may be controlled by a water injection time period and a water injection cycle. The injection device 100 may generate driving signals for controlling the check valve 422, the air pump 434, an air valve 1010, and the step motor 442 based on the water injection time period and the water injection cycle and may output the driving signals to the components, respectively.

The injection device 100 may determine a rotation angle of the nozzle 216 based on the outdoor unit size information received from the outdoor unit 110. The processor 210 may determine the rotation angle to rotate the nozzle 216 according to a size of the outdoor heat exchanger 230 of the outdoor unit 110. The injection device 100 may generate the driving signal of the step motor 442 to drive the step motor 442 according to the determined rotation angle and output the driving signal to the step motor 442.

The injection device 100 may predict the amount of condensate water supplied from the indoor unit 120, based on the indoor unit state information received from the indoor unit 120. The injection device 100 may be connected to the indoor unit 120 through a hose 1020. The water tank 218 of the injection device 100 may receive the condensate water from the indoor unit 120 through the hose 1020. When the injection device 100 receives the condensate water from the indoor unit 120, the injection device 100 may predict the amount of condensate water to be supplied, based on the indoor unit state information. According to an embodiment of the disclosure, when the indoor temperature/humidity measured by the indoor unit 120 is higher than a reference value, the injection device 100 may predict that the amount of condensate water is to increase, and when the indoor temperature/humidity measured by the indoor unit 120 is lower than the reference value, the injection device 100 may predict that the amount of condensate water is to decrease. According to an embodiment of the disclosure, based on the target temperature/humidity set by the indoor unit 120, when the target temperature/humidity is lower than the indoor temperature/humidity, the injection device 100 may predict that the amount of condensate water is to increase, and when the target temperature/humidity is higher than the indoor temperature/humidity, the injection device 100 may predict that the amount of condensate water is to decrease. Also, according to an embodiment of the disclosure, the injection device 100 may predict the amount of condensate water to be supplied from the indoor unit 120 to the injection device 100, by receiving information about the amount of indoor dehumidification (the amount of condensate water) of the indoor unit 120.

The injection device 100 may predict the amount of condensate water to be supplied, based on the amount of condensate water predicted based on the indoor unit state information. The injection device 100 may predict a water level of the water tank based on the amount of water stored in the water tank 218 and the amount of condensate water to be supplied. The injection device 100 may predict a water-level change of the water tank 218 by using the amount of water use per hour of the water tank 218 and the predicted amount of a condensate water supply per hour. When the water level of the water tank 218 is predicted to decrease to a level equal to or lower than a lowest water level within a reference time period, the injection device 100 may decrease the amount of water injection per hour.

According to an embodiment of the disclosure, when the water level of the water tank 218 is predicted to increase to a level higher than a highest water level within a reference time period, the injection device 100 may block the supply of the condensate water from the indoor unit 120. The injection device 100 may include a predetermined valve for blocking the supply of water supplied to the water tank 218 and may block the supply of the condensate water supplied from the indoor unit 120.

Also, according to an embodiment of the disclosure, when the water level of the water tank 218 is predicted to increase to a level higher than a lowest water level within a reference time period, the injection device 100 may increase the amount of water injection per hour. The injection device 100 may decrease a speed by which the water level of the water tank 218 is increased, by increasing the amount of water consumption per hour.

The injection device 100 may output the injection device state information to the indoor unit 120. According to an embodiment of the disclosure, the indoor unit 120 may receive the injection device state information from the injection device 100 and may output the injection device state information through an output interface of the indoor unit 120. Also, according to an embodiment of the disclosure, the indoor unit 120 may transmit the injection device state information to a user device or a server.

Figure 11:
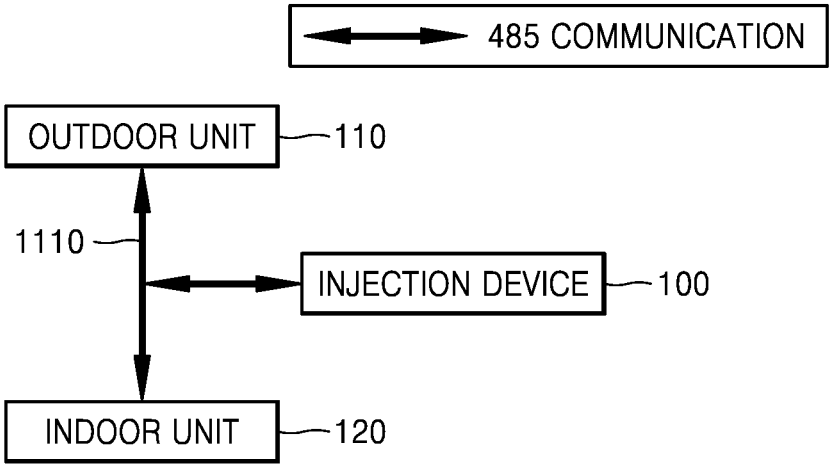
FIG. 11 is a diagram showing a method according to which an outdoor unit, an indoor unit, and an injection device are connected to each other, according to an embodiment of the disclosure.

FIG. 11 is a diagram showing a method according to which an outdoor unit, an indoor unit, and an injection device are connected to one another, according to an embodiment of the disclosure.

According to an embodiment of the disclosure, the injection device 100, the outdoor unit 110, and the indoor unit 120 may be connected to one another through 485 communication. The outdoor unit 110 and the indoor unit 120 may be connected to each other through the 485 communication according to a previous method. When a 485 communication cable 1110 to which the outdoor unit 110 and the indoor unit 120 are connected is connected to the injection device 100 in a split form, the injection device 100 may be able to communicate with the outdoor unit 110 and the indoor unit 120 through the 485 communication.

The 485 communication may enable all devices connected through the 485 communication cable 1110 to output a data packet. The data packet output through the 485 communication cable 1110 may include transmitter information and data. The all devices connected to the 485 communication cable 1110 may receive the data packet output through the 485 communication cable 1110. According to an embodiment of the disclosure, the injection device 100 may be connected to the 485 communication cable 1110 between the outdoor unit 110 and the indoor unit 120, and thus, may receive all data packets output from the outdoor unit 110 or the indoor unit 120. The outdoor unit state information and the indoor unit state information may be information output also in a previous air conditioner, and thus, according to an embodiment of the disclosure, the injection device 100 may be mounted without a change of operations of the outdoor unit 110 or the indoor unit 120.

Also, the injection device 100 may output the injection device state information through the 485 communication cable 1110. The indoor unit 120 may receive the injection device state information from the injection device 100 through the 485 communication cable 1110.

Figure 12:
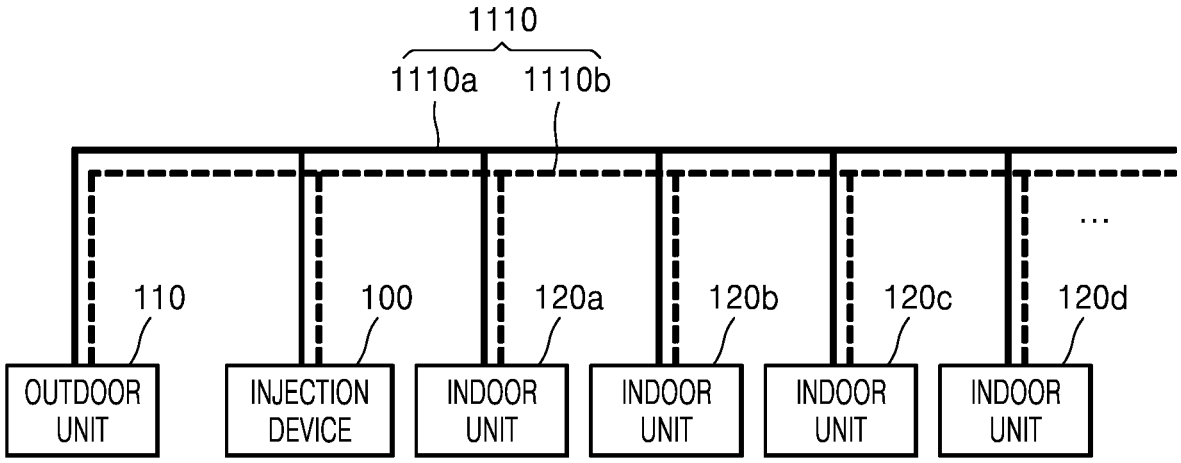
FIG. 12 is a diagram showing a method according to which an outdoor unit, an injection device, and a plurality of indoor units are connected to each other, according to an embodiment of the disclosure.

FIG. 12 is a diagram showing a method according to which an outdoor unit, an injection device, and a plurality of indoor units are connected to one another, according to an embodiment of the disclosure.

According to an embodiment of the disclosure, the indoor unit 120 may include a plurality of indoor units 120*a*, 120*b*, 120*c*, and 120*d*. According to an embodiment of the disclosure, the plurality of indoor units 120*a*, 120*b*, 120*c*, and 120*d* may include stand-type air conditioners and at least one wall-hanging air conditioner. Also, according to an embodiment of the disclosure, the plurality of indoor units 120*a*, 120*b*, 120*c*, and 120*d* may include a plurality of ceiling-type air conditioners. Also, according to an embodiment of the disclosure, the plurality of indoor units 120*a*, 120*b*, 120*c*, and 120*d* may include a plurality of wall-hanging-type air conditioners.

The injection device 100, the outdoor unit 110, and the plurality of indoor units 120*a*, 120*b*, 120*c*, and 120*d* may be connected to one another through 485 communication. All of the plurality of indoor units 120*a*, 120*b*, 120*c*, and 120*d* may be connected to the 485 communication cable 1110.

According to an embodiment of the disclosure, the 485 communication cable 1110 may be implemented as a two-wire type method having two strands of communication cables. The two-wire type method is a method of communicating by connecting TX+ with RX+ and TX− with RX− by using two strands of wires. The 485 communication of the two-wire type may use a TRXD+ cable 1110*a* and a TRXD− cable 1110*b*. Each of the injection device 100, the outdoor unit 110, and the indoor unit 120 may include a TRXD+ terminal and a TRXD− terminal. The injection device 100, the outdoor unit 110, and the indoor unit 120 may be connected to each of the two 485 communication cables 1110*a* and 1110*b*.

Based on this structure, the air conditioner 10 may configure TX+ and RX+ by using the TRXD+ cable 1110*a* and may configure TX− and RX− by using the TRXD− cable 1110*b*. According to the two-wire type method, a multi-master structure is implemented in which all devices connected to the 485 communication cable 1110 operate as masters. In the two-wire type method, transmission and reception may be performed through the two 485 communication cables 1110*a* and 1110*b* and half duplex may be performed.

FIG. 13 is a diagram showing a method of controlling a water injection operation according to state information of an indoor unit, state information of an outdoor unit, or state information of an injection device, according to an embodiment of the disclosure.

According to an embodiment of the disclosure, the injection device 100 may control a water injection operation based on indoor unit state information, outdoor unit state information, or injection device state information. The injection device 100 may control the water injection operation by controlling at least one of a water injection time period or a water injection cycle.

According to an embodiment of the disclosure, the injection device 100 may control the water injection operation based on the indoor unit state information.

According to an embodiment of the disclosure, the injection device 100 may increase the water injection time period or decrease the water injection cycle, as indoor temperature/humidity measured by the indoor unit 120 increases. Also, the injection device 100 may decrease the water injection time period or increase the water injection cycle, as the indoor temperature/humidity measured by the indoor unit 120 decreases. When the indoor temperature/humidity measured by the indoor unit 120 increases, heat discharged to the outdoor unit 110 may increase, and thus, the injection device 100 may increase the amount of water injection to increase heat discharge efficiency of the outdoor unit 110.

According to an embodiment of the disclosure, the injection device 100 may decrease the water injection time period or increase the water injection cycle, as target temperature/humidity set by the indoor unit 120 increases. Also, the injection device 100 may increase the water injection time period or decrease the water injection cycle, as the target temperature/humidity set by the indoor unit 120 decreases. When the target temperature/humidity set by the indoor unit 120 decreases, the amount of cooling of the indoor unit 120 may increase, and thus, heat discharged to the outdoor unit 110 may increase. Thus, the injection device 100 may increase the amount of water injection in order to increase heat discharge efficiency of the outdoor unit 110.

Also, according to an embodiment of the disclosure, the injection device 100 may increase the water injection time period or decrease the water injection cycle, as the amount of indoor dehumidification (the amount of condensate water) of the indoor unit 120 increases. Also, the injection device 100 may decrease the water injection time period or increase the water injection cycle, as the amount of indoor dehumidification (the amount of condensate water) of the indoor unit 120 decreases. When the amount of indoor dehumidification of the indoor unit 120 increases, the amount of condensate water supplied to the injection device 100 may increase. Thus, as the amount of indoor dehumidification increases, the injection device 100 may increase the amount of water use to maintain a water level of the water tank 218 of the injection device 100 at an appropriate level.

According to an embodiment of the disclosure, the injection device 100 may control the water injection operation based on the state information of the outdoor unit 110.

According to an embodiment of the disclosure, as a compressor operating frequency of the outdoor unit 110 increases, the injection device 100 may increase the water injection time period or decrease the water injection cycle. Also, as the compressor operating frequency of the outdoor unit 110 decreases, the injection device 100 may decrease the water injection time period or increase the water injection cycle. When the compressor operating frequency of the outdoor unit 110 increases, the amount of heat discharge required from the outdoor unit 110 may be increased. According to an embodiment of the disclosure, when the compressor operating frequency increases, the injection device 100 may increase the amount of water injection in order to increase heat discharge efficiency of the outdoor unit 110.

Also, according to an embodiment of the disclosure, as outdoor temperature measured by the outdoor unit 110 increases, the injection device 100 may increase the water injection time period or decrease the water injection cycle. Also, as the outdoor temperature measured by the outdoor unit 110 decreases, the injection device 100 may decrease the water injection time period or increase the water injection cycle. When the outdoor temperature measured by the outdoor unit 110 increases, ambient temperature of the outdoor heat exchanger 230 may increase, and thus, heat exchange efficiency may be dropped. As the outdoor temperature increases, the injection device 100 may increase the amount of water injection to increase heat exchange efficiency in an environment in which the heat exchange efficiency is decreased.

Also, according to an embodiment of the disclosure, as a fan RPM of the outdoor unit 110 increases, the injection device 100 may increase the water injection time period or decrease the water injection cycle. Also, as the fan RPM of the outdoor unit 110 decreases, the injection device 100 may decrease the water injection time period or increase the water injection cycle. When the fan RPM of the outdoor unit 110 increases, the amount of heat discharge required from the outdoor unit 110 may be increased. According to an embodiment of the disclosure, when the fan RPM increases, the injection device 100 may increase the amount of water injection in order to increase heat discharge efficiency of the outdoor unit 110.

Also, according to an embodiment of the disclosure, the injection device 100 may control the water injection operation based on the state information of the injection device 100.

According to an embodiment of the disclosure, as the water level of the water tank of the injection device 100 increases, the injection device 100 may increase the water injection time period or decrease the water injection cycle. Also, as the water level of the water tank of the injection device 100 decreases, the injection device 100 may decrease the water injection time period or increase the water injection cycle. When the water level of the water tank of the injection device 100 is high, there is a concern that the water of the water tank 218 may spill over. Thus, when the water level of the water tank is high, the injection device 100 may increase the amount of water injection in order to increase the speed of water consumption of the water tank 218. When the water level of the water tank of the injection device 100 is low, there is a possibility that the water tank 218 may become short of water to stop the water injection operation. Thus, when the water level of the water tank is low, the injection device 10 may decrease the amount of water injection in order to decrease the water consumption speed of the water tank 218.

According to an embodiment of the disclosure, the injection device 100 may control the water injection operation based on the plurality of pieces of state information of FIG. 13 according to a predetermined priority order. For example, the injection device 100 may set a highest priority order for the outdoor unit state information, an intermediate priority order for the injection device state information, and a lowest priority order for the indoor unit state information.

Also, according to an embodiment of the disclosure, the injection device 100 may set the priority order among the plurality of pieces of state information. For example, the injection device 100 may set a highest priority order for a compressor operating frequency and a fan RPM, a next-highest priority order for indoor temperature/humidity, target temperature/humidity, and a water level of the water tank, and a third highest priority order for the amount of indoor dehumidification and outdoor temperature.

Also, according to an embodiment of the disclosure, the injection device 100 may calculate an assessment value by assigning weights to the plurality of pieces of state information and linearly combining numerical values converted from the plurality of pieces of state information. The injection device 100 may set the water injection time period and the water injection cycle based on the assessment value obtained by linearly combining the values of the plurality of pieces of state information.

Figure 14:
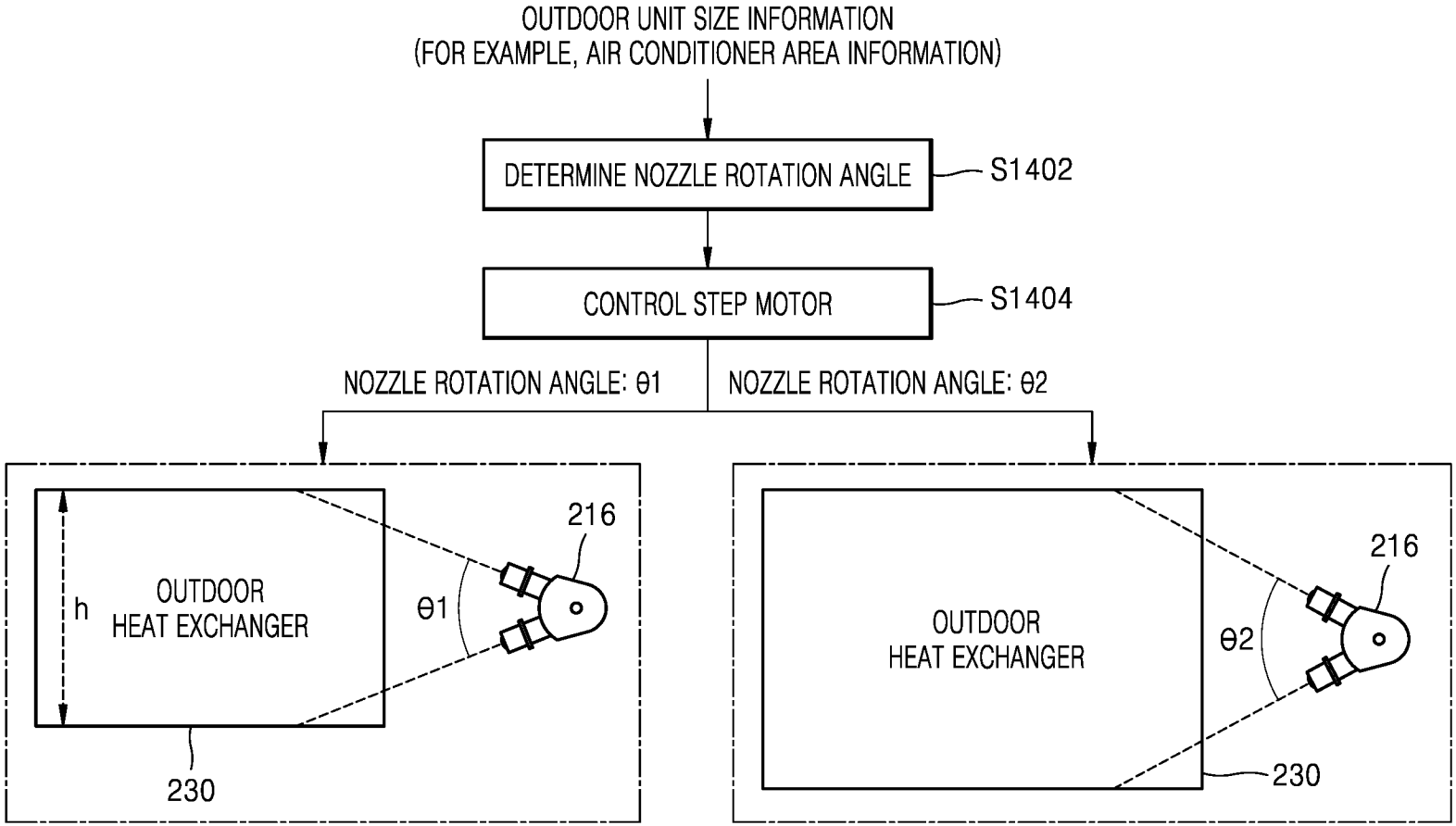
FIG. 14 is a diagram showing a process of determining a nozzle rotation angle according to an embodiment of the disclosure.

FIG. 14 is a diagram showing a process of determining a nozzle rotation angle according to an embodiment of the disclosure.

According to an embodiment of the disclosure, the injection device 100 may determine the nozzle rotation angle based on outdoor unit size information. The injection device 100 may receive the outdoor unit size information from the outdoor unit 110. The outdoor unit 110 may transmit the outdoor unit size information to the injection device 100. According to an embodiment of the disclosure, the outdoor unit 110 may cyclically transmit the outdoor unit size information. Also, according to an embodiment of the disclosure, the outdoor unit 110 may transmit the size information in an initial setting mode executed after the outdoor unit 110 is mounted.

In operation S1402, the injection device 100 may determine the nozzle rotation angle based on the outdoor unit size information. Based on the outdoor unit size information, the injection device 100 may determine the nozzle rotation angle in order to inject water throughout an area of the outdoor heat exchanger 230. The nozzle 216 may inject the water by being rotated by the step motor 442 in right and left directions with respect to an axis. The nozzle rotation angle may be determined such that the nozzle 216 may inject water within an outdoor unit area to an edge of the outdoor unit area.

According to an embodiment of the disclosure, the outdoor unit size information may correspond to air conditioner area information. The injection device 100 may store a look-up table storing the nozzle rotation angle according to an air conditioner area. The injection device 100 may determine, based on the look-up table, the nozzle rotation angle according to the air conditioner area.

Also, according to an embodiment of the disclosure, the outdoor unit size information may include a height h of the outdoor heat exchanger 230. The injection device 100 may be arranged at a side surface of the outdoor unit 110 and may inject water at a left side or a right side of the outdoor unit heat exchanger 230. The injection device 100 may determine the rotation angle of the nozzle 216 to cover the height h of the outdoor heat exchanger 230.

When the nozzle rotation angle is determined, the injection device 100 may control the step motor 442 to reciprocally rotate the nozzle 216 at the determined nozzle rotation angle, in operation S1404. The injection device 100 may set a rotation range of the step motor 442 according to the determined rotation angle. As illustrated in FIG. 14, for example, a case where the nozzle rotation angle is set to be θ1 and a case where the nozzle rotation angle is set to be θ2 are described. θ1 is a less angle than θ2. The injection device 100 may set the rotation range of the step motor 442 to correspond to the nozzle rotation angle. When the nozzle rotation angle is set to be θ2, the rotation range of the step motor 442 may be set to be greater than when the nozzle rotation angle is set to be θ1.

The injection device 100 may control the step motor 442 to reciprocally rotate within the rotation range of the step motor 442. The step motor 442 may repeat an operation of upwardly rotating and downwardly rotating within the rotation range. The processor 210 may generate a driving signal of the step motor to control the step motor 442 to repeat the operation of upwardly rotating and downwardly rotating within the rotation range and may output the driving signal to the step motor 442.

Figure 15:
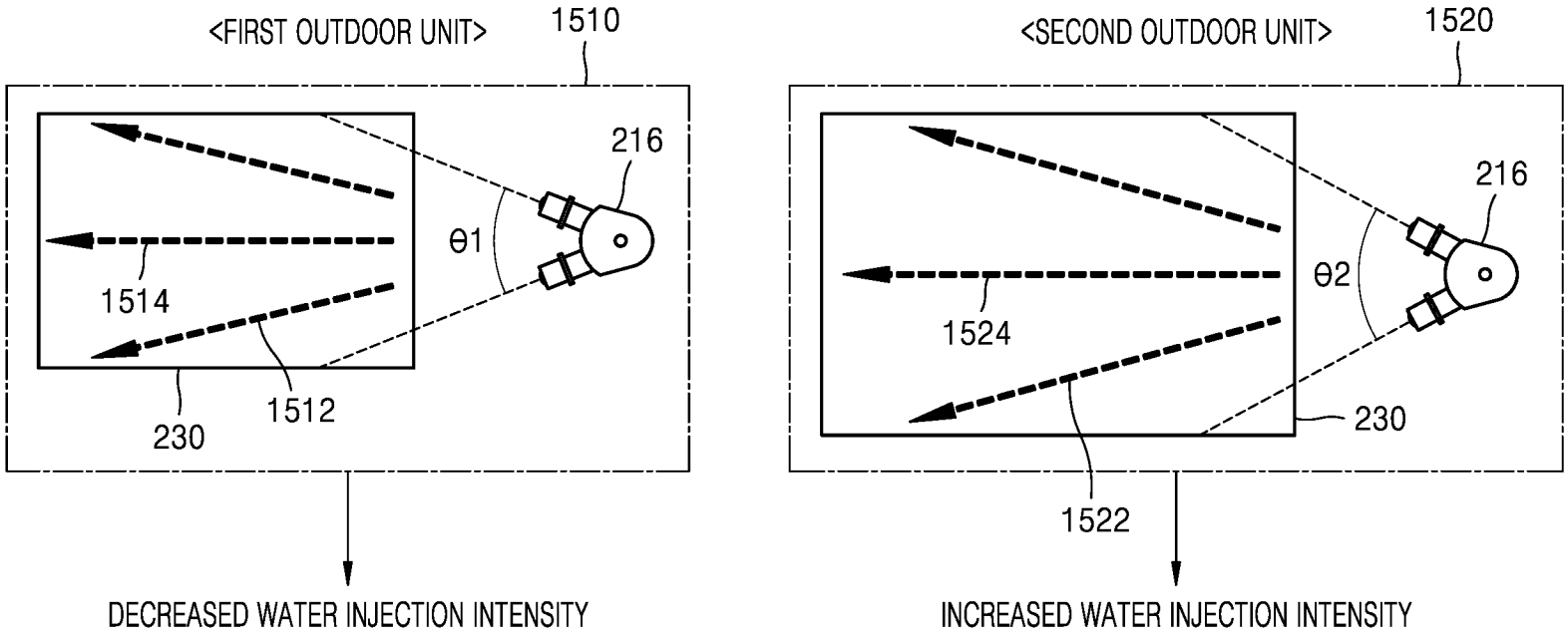
FIG. 15 is a diagram showing an operation of controlling a water injection intensity, according to an embodiment of the disclosure.

FIG. 15 is a diagram showing an operation of controlling a water injection intensity according to an embodiment of the disclosure.

According to an embodiment of the disclosure, the injection device 100 may control the water injection intensity according to outdoor unit size information. As an outdoor unit size increases, the injection device 100 may increase the water injection intensity, and as the outdoor unit size decreases, the injection device 100 may decrease the water injection intensity. For example, in FIG. 15, in the case of a second outdoor unit 1520 having a greater size than a first outdoor unit 1510, the water injection intensity may be greater than in the case of the first outdoor unit 1510. In the example of FIG. 15, a water stream 1524 may have a greater water injection intensity than a water stream 1514. When the outdoor unit size increases, the water stream may have to reach a farther distance, and thus, the injection device 100 may increase the water injection intensity as the outdoor unit size increases.

Also, according to an embodiment of the disclosure, while the nozzle 216 rotates, the injection device 100 may adjust the water injection intensity of the water injected at the center of the outdoor heat exchanger 230. The injection device 100 may adjust the water injection intensity according to a target distance which the water has to reach. In a direction in which the target distance which the water has to reach is long, the injection device 100 may increase the water injection intensity, and in a direction in which the target distance which the water has to reach is short, the injection device 100 may decrease the water injection intensity. For example, the water stream 1514 at the central portion of the first outdoor unit 1510 may be less intense than a water stream 1512 at a peripheral portion of the first outdoor unit 1510. Also, for example, the water stream 1524 at the central portion of the second outdoor unit 1520 may be less intense than a water stream 1522 at a peripheral portion of the second outdoor unit 1520. At the peripheral portion, the distance which the water stream has to reach increases, and thus, the injection device 100 may increase the water injection intensity at a peripheral portion of the outdoor heat exchanger 230 to be greater than the water injection intensity at the central portion of the outdoor heat exchanger 230.

According to an embodiment of the disclosure, the injection device 100 may control the water injection intensity by adjusting the amount of injected water and pressure of the air pump 434. The injection device 100 may increase the water injection intensity by increasing the amount of injected water and increasing the pressure of the air pump 434. Also, the injection device 100 may decrease the water injection intensity by decreasing the amount of injected water and decreasing the pressure of the air pump 434.

The injection device 100 may control the amount of injected water by adjusting the check valve 422. The injection device 100 may increase the amount of injected water by increasing the degree of openness of the check valve 422. The injection device 100 may decrease the amount of injected water by decreasing the degree of openness of the check valve 422.

Figure 16:
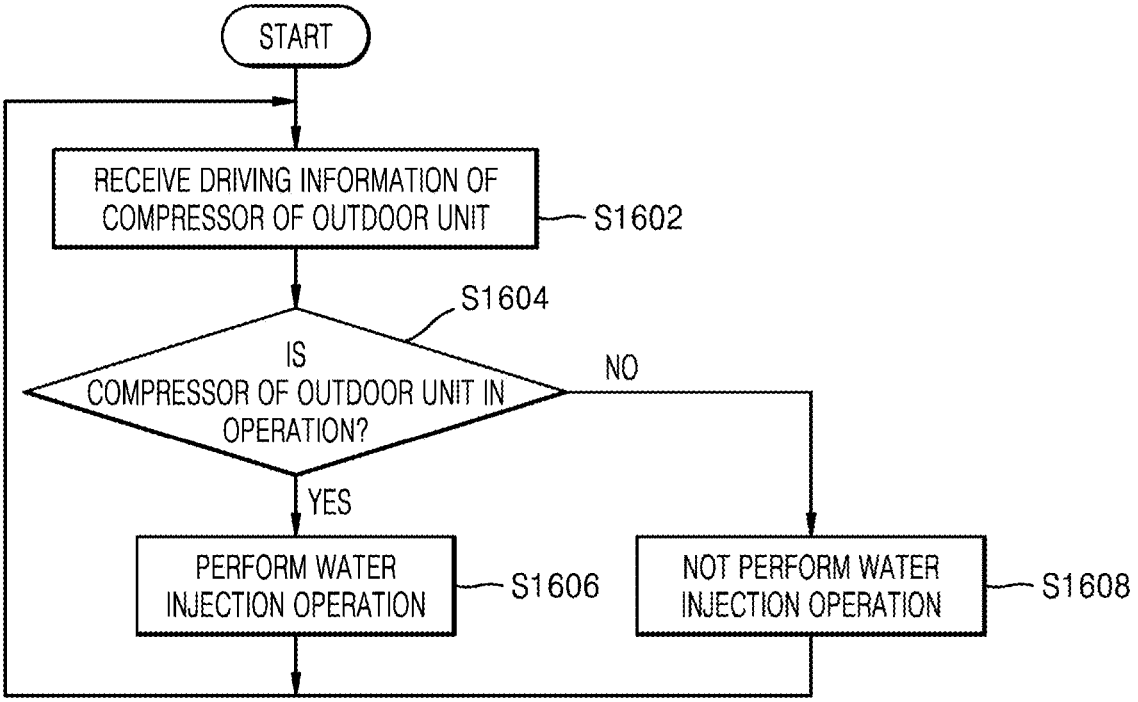
FIG. 16 is a diagram showing a process of performing a water injection operation, according to an embodiment of the disclosure.

FIG. 16 is a diagram showing a process of performing a water injection operation according to an embodiment of the disclosure.

According to an embodiment of the disclosure, the injection device 100 may control the water injection operation according to an operating state of the outdoor unit 110. The injection device 100 may receive driving information from the outdoor unit 110 and may or may not perform the water injection operation according to the received driving information.

In operation S1602, the injection deice 100 may receive compressor driving information from the outdoor unit 110. According to an embodiment of the disclosure, the compressor driving information may include information about whether or not the compressor 234 is operating and a compressor operating frequency.

Next, in operation S1604, whether or not the compressor 234 of the outdoor unit 110 is operating may be determined. Based on the information about whether or not the compressor 234 is operating, the injection device 100 may determine whether or not the compressor 234 of the outdoor unit 110 is operating.

When the compressor 234 of the outdoor unit 110 is operating, the injection device 100 may perform the water injection operation in operation S1606. When the compressor 234 of the outdoor unit 110 is not operating, the injection device 100 may not perform the water injection operation in operation S1608.

According to an embodiment of the disclosure, the injection device 100 may perform the water injection operation only when the outdoor unit 110 is performing a heat exchange operation and may not perform the water injection operation when the outdoor unit 110 is not performing the heat exchange operation. Based on this configuration, the injection device 100 may reduce energy consumption and prevent an unnecessary water injection operation.

Figure 17:
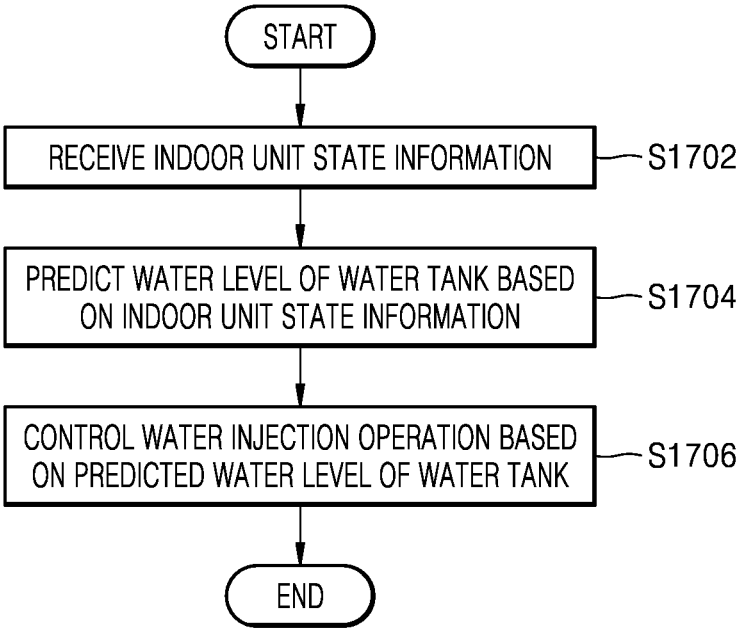
FIG. 17 is a diagram showing a process of predicting a water level of a water tank based on state information of an indoor unit, according to an embodiment of the disclosure.

FIG. 17 is a diagram showing a process of predicting a water level of a water tank based on indoor unit state information, according to an embodiment of the disclosure.

According to an embodiment of the disclosure, a water level of the water tank 218 may be predicted based on the indoor unit state information. When the injection device 100 receives condensate water from the indoor unit 120, the amount of supplied condensate water may be different depending on an operation of the indoor unit 120. As the heat exchange amount of an indoor heat exchanger of the indoor unit 120 increases, the amount of condensate water of the indoor unit 120 may increase, and as the heat exchange amount of the indoor heat exchanger of the indoor unit 120 decreases, the amount of condensate water of the indoor unit 120 may decrease. Based on the indoor unit state information, the injection device 100 may predict the amount of condensate water to be generated in the indoor unit 120. Also, the injection device 100 may predict a subsequent change in the water level of the water tank, based on the amount of condensate water to be supplied from the indoor unit 120 and a current water level of the water tank.

In operation S1702, the injection device 100 may receive the indoor state information from the indoor unit 120. The indoor unit state information may be cyclically output from the indoor unit 120. The injection device 100 may receive, through 485 communication, the indoor unit state information cyclically output from the indoor unit 120. The indoor unit state information may include at least one of indoor temperature/humidity, target temperature/humidity, or the amount of indoor dehumidification (the amount of condensate water).

Next, in operation S1704, the injection device 100 may predict the water level of the water tank based on the indoor unit state information. The injection device 100 may predict the amount of condensate water to be supplied per hour, based on the indoor unit state information. The injection device 100 may predict the amount of condensate water to be supplied per hour based on the indoor temperature/humidity and the target temperature/humidity. The indoor temperature and the indoor humidity may be values measured by the indoor unit 120. The target temperature may be a value set by a user through a user interface of the indoor unit 120. The target humidity may be set during the factory shipment of the air conditioner 10 or may be set by an engineer.

According to an embodiment of the disclosure, the injection device 100 may predict the heat exchange amount of an indoor heat exchanger per hour, based on the indoor temperature and the target temperature. The injection device 100 may predict the amount of condensate water to be generated per hour based on the heat exchange amount of the indoor heat exchanger per hour. The injection device 100 may determine the amount of condensate water to be generated per hour as the amount of condensate water to be supplied per hour.

Also, according to an embodiment of the disclosure, the injection device 100 may determine the amount of condensate water to be supplied per hour, by using a look-up table storing the amount of condensate water to be supplied per hour according to the indoor temperature and the target temperature. The injection device 100 may store the look-up table in the memory 214. The injection device 100 may obtain information about the amount of condensate water to be supplied per hour from the look-up table based on indoor temperature information and target temperature information of the indoor unit 120.

The injection device 100 may obtain a water level of the water tank 218 measured by a water-level sensor of the water tank 218. The injection device 100 may predict a subsequent water level of the water tank based on the measured water level of the water tank and the amount of condensate water to be supplied per hour. The injection device 100 may predict the water level of the water tank according to time. When the injection device 100 predicts the water level of the water tank according to time, the injection device 100 may also take into account the amount of water consumption per hour according to the water injection operation. For example, the injection device 100 may predict the water level of the water tank according to time, by adding the amount of condensate water to be supplied per hour to the measured water level of the water tank and subtracting the amount of water consumption per hour.

According to an embodiment of the disclosure, when the air conditioner 10 includes a plurality of indoor units 120, the injection device 100 may calculate the individual amount of condensate water to be supplied per hour for each of the plurality of indoor units 120. The injection device 100 may calculate the amount of condensate water to be supplied per hour by adding the individual amount of condensate water to be supplied per hour of each of the indoor units 120.

Next, in operation S1706, the injection device 100 may control the water injection operation based on the predicted water level of the water tank. When the water level of the water tank is predicted to decrease to be lower than a minimum reference water level within a reference time period, the injection device 100 may decrease the amount of water injection. For example, when the water level of the water tank is predicted to decrease to be less than the minimum reference water level within 1 minute, the injection device 100 may decrease the amount of water injection by 20%. Also, when the water level of the water tank is predicted to increase to be greater than a maximum reference water level within a reference time period, the injection device 100 may increase the amount of water injection. For example, when the water level of the water tank is predicted to increase to be greater than the maximum reference water level within 1 minute, the injection device 100 may increase the amount of water injection by 20%.

Figure 18:
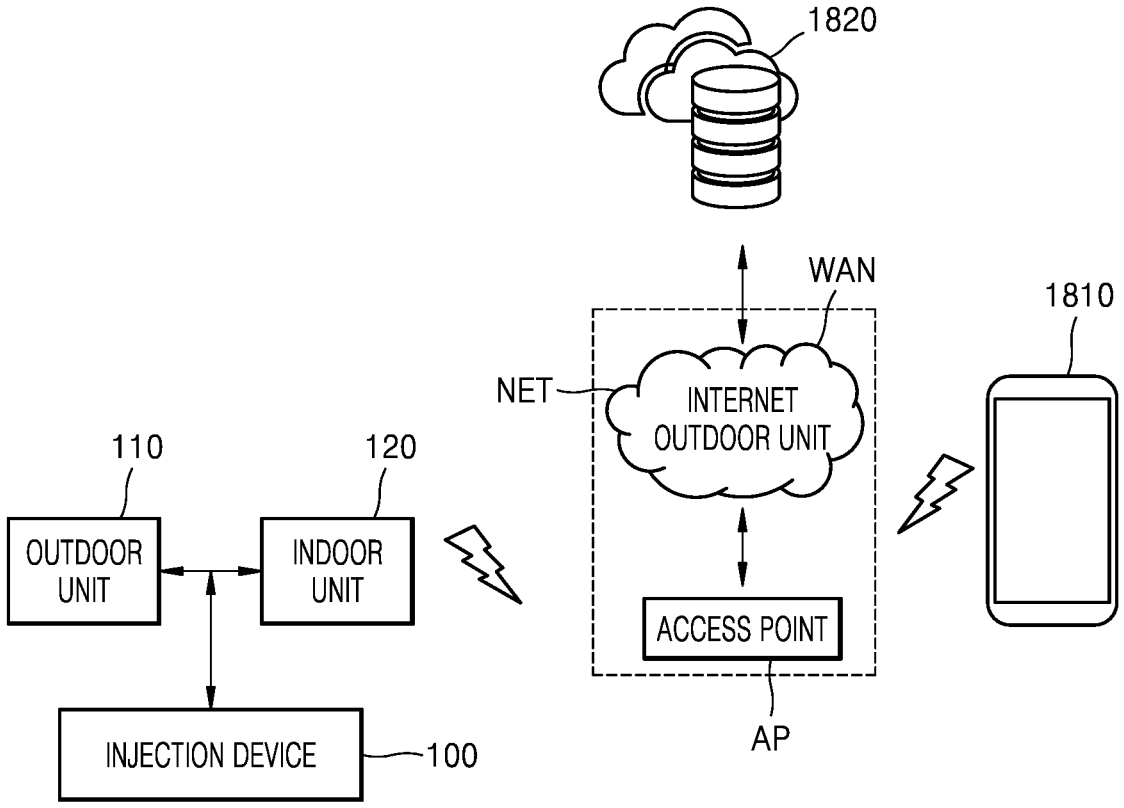
FIG. 18 is a diagram of an indoor unit, a user device, and a server, according to an embodiment of the disclosure.

FIG. 18 is a diagram of an indoor unit, a user device, and a server according to an embodiment of the disclosure.

According to an embodiment of the disclosure, the indoor unit 120 may communicate with a user device 1810 and a server 1820 through a communication module (not shown). The indoor unit 120 may be connected to another home appliance, the user device 1810, or the server 182 through a network NET. The outdoor unit 110 and the injection device 100 may be connected to the indoor unit 120 through 485 communication.

The server 1820 may manage user account information and information with respect to the indoor unit 120 linked to a user account. For example, a user may generate the user account by accessing the server 1820 through the user device 1810. The user account may be identified by an identifier and a password set by the user. The server 1820 may register the indoor unit 120 to the user account according to a predetermined procedure. For example, the server 1820 may register the indoor unit 120 by linking identification information (for example, a serial number or an MAC address) of the indoor unit 120 to the user account.

The user device 1810 may include a communication module for communicating with the indoor unit 120 and the server 1820, a user interface for receiving a user input or outputting information to the user, at least one processor controlling an operation of the user device 1810, and at least one memory storing a program for controlling the operation of the user device 1810.

The user device 1810 may be handheld by the user or may be arranged in a user's house, office, or the like. The user device 1810 may include, for example, a personal computer, a terminal, a portable telephone, a smartphone, a handheld device, a wearable device, etc., but is not limited thereto.

The memory of the user device 1810 may store a program (for example, an application) for controlling the indoor unit 120. The user device 1810 may be sold with or without an application for controlling the indoor unit 120 being installed. When the user device 1810 is sold without the application for controlling the indoor unit 120 being installed, the user may download the application from an external server providing the application and install the application in the user device 1810.

The user may control the indoor unit 120 by using the application installed in the user device 1810. For example, when the user executes the application installed in the user device 1810, the identification information of the indoor unit 120 linked to the user device 1810 via the same user account may be displayed on an execution window of the application. The user may perform an intended controlling operation on the indoor unit 120 through the application execution window. When the user inputs a control command with respect to the indoor unit 120 through the application execution window, the user device 1810 may directly transmit the control command to the indoor unit 120 through a network or may transmit the control command to the indoor unit 120 through the server 1820.

The network NET may include both a wired network and a wireless network. The wired network may include a cable network, a telephone network, or the like, and the wireless network may include all networks for transmitting and receiving signals through radio waves. The wired network and the wireless network may be connected to each other.

The network NET may include a WAN, such as the Internet, a LAN established based on an AP, and a wireless personal area network (WPAN) not through the AP. The WPAN may include Bluetooth (Bluetooth™, IEEE 802.15.1), Zigbee (IEEE 802.15.4), WFD, near field communication (NFC), Z-Wave, etc., but is not limited thereto.

The AP may connect the LAN to which the indoor unit 120 and the user device 1810 are connected to the WAN to which the server 1820 is connected. The indoor unit 120 or the user device 1810 may be connected to the server 1830 through the WAN.

The AP may communicate with the indoor unit 120 and the user device 1810 through wireless communication, such as Wifi (Wifi™, IEEE 802.11), etc., and may access the WAN by using wired communication.

The indoor unit 120 may transmit information about an operation or a state to the server 1820 through the network NET. For example, the indoor unit 120 may transmit the information about the operation or the state to the server 1820 through Wifi (Wifi™, IEEE 802.11) communication. Also, the indoor unit 120 may transmit information about an operation or a state of the outdoor unit 110 and information about an operation or a state of the injection device 100 to the server 1820.

When a Wifi communication module is not provided in the indoor unit 120, the indoor unit 120 may transmit the information about the operation or the state to the server 1820 through another home appliance having a Wifi communication module. For example, when the indoor unit 120 transmits the information about the operation or the state to the other home appliance through a short-range wireless network (for example, BLE communication), the other home appliance may transmit the information about the operation or the state of the indoor unit 120 to the server 1820. Also, for example, when the Wifi communication module is not provided in the indoor unit 120, the indoor unit 120 may be connected to a communication relaying device in a wired manner and may perform 485 communication with Wifi communication through the communication relaying device.

The indoor unit 120 may provide the information about the operation or the state of the indoor unit 120, the information about the operation or the state of the outdoor unit 110, or the information about the operation or the state of the injection device 100 to the server 1820 according to pre-authentication of the user. The information transmission to the server 1820 may be performed when a request is received from the server 1820, may be performed when a predetermined event occurs in the indoor unit 120, may be cyclically performed, or may be performed in real time.

When the information about the operation or the state of the indoor unit 120, the information about the operation or the state of the outdoor unit 110, or the information about the operation or the state of the injection device 100 is received from the indoor unit 120, the server 1820 may update information pre-stored with respect to the air conditioner 10. The server 1820 may transmit the information about the operation or the state of the indoor unit 120, the outdoor unit 110, or the injection device 100 to the user device 1810 through the network NET.

When a request from the user device 1810 is received, the server 1820 may transmit, to the user device 1810, the information about the operation or the state of the indoor unit 120, the outdoor unit 110, or the injection device 100. For example, when the user executes, by using the user device 1810, an application connected to the server 1820, the user device 1810 may, through the application, request and receive, from the server 1810, the information about the operation or the state of the indoor unit 120, the outdoor unit 110, or the injection device 100. When the information about the operation or the state is received from the indoor unit 120, the server 1820 may transmit, in real time, the information about the operation or the state of the indoor unit 120, the outdoor unit 110, or the injection device 100 to the user device 1810. The server 1820 may cyclically transmit, to the user device 1810, the information about the operation or the state of the indoor unit 120, the outdoor unit 110, or the injection device 100. The user device 1810 may display the information about the operation or the state of the indoor unit 120, the outdoor unit 110, or the injection device 100 on an application execution window to transmit the information about the operation or the state of the indoor unit 120, the outdoor unit 110, or the injection device 100 to the user.

The indoor unit 120 may obtain various information from the server 1820 and provide the obtained information to the user. Also, the indoor unit 120 may receive, from the server 1820, pre-installed software or a file for updating data related to the pre-installed software, and based on the received file, may update the pre-installed software or the data related to the pre-installed software.

The indoor unit 120 may operate according to a control command received from the server 1820. For example, when the indoor unit 120 obtains user's pre-authentication for operating according to a control command of the server 1820 even when there is no user input, the indoor unit 120 may operate according to the control command received from the server 1820. The control command received from the server 1820 may include a control command input by the user through the user device 1820, a control command generated by the server 1820 based on a predetermined condition, etc., but is not limited thereto.

Figure 19:
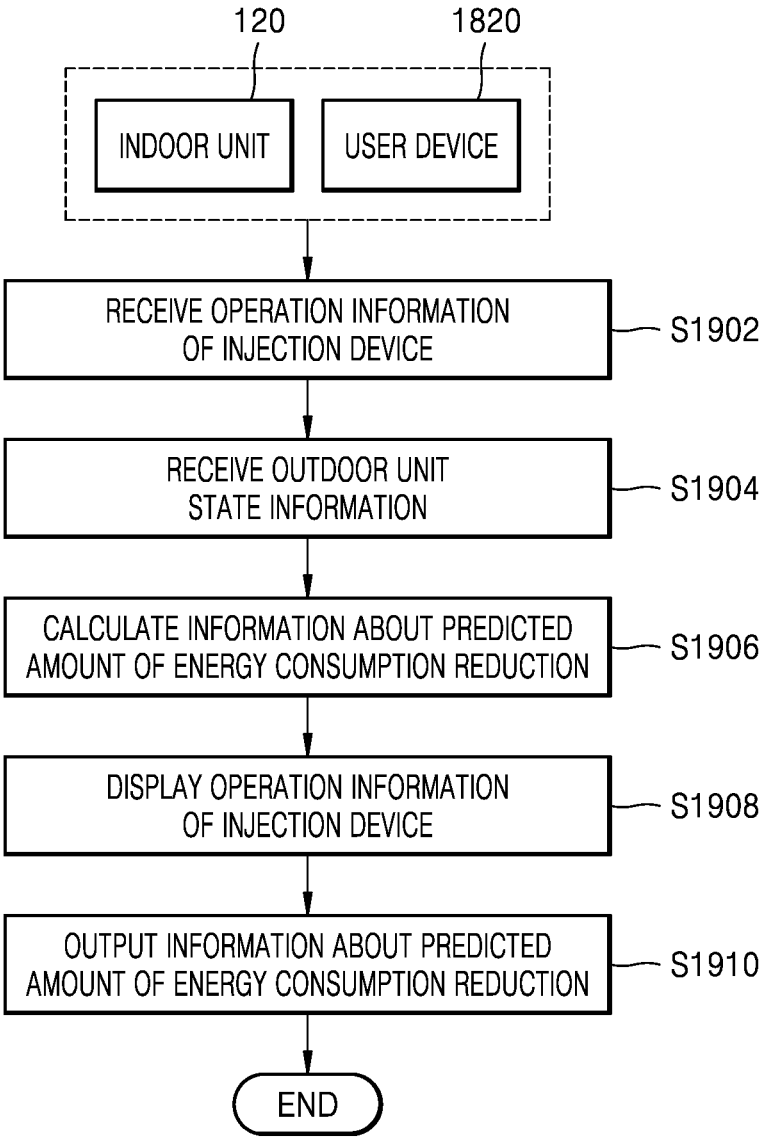
FIG. 19 is a diagram showing a process of outputting information about a predicted amount of energy consumption reduction, according to an embodiment of the disclosure.

FIG. 19 is a diagram showing a process of outputting information about the predicted amount of energy consumption reduction according to an embodiment of the disclosure.

According to an embodiment of the disclosure, energy consumption of the outdoor unit 110 may be reduced by the injection device 100. The outdoor unit 110 may discharge heat via the outdoor heat exchanger 230. The injection device 100 may inject water to a surface of the outdoor heat exchanger 230 to improve heat exchange efficiency of the outdoor heat exchanger 230. By the water injection operation of the injection device 100, power consumption for discharging heat from the outdoor unit 110 may be reduced. According to an embodiment of the disclosure, a predetermined electronic device may calculate the predicted amount of energy consumption reduction of the outdoor unit 110 according to the injection device 100. The predetermined electronic device may correspond to at least one of the injection device 100, the indoor unit 120, the user device 1810, or the server 1820. Also, the calculated predicted amount of energy consumption reduction may be output through the indoor unit 120 or the user device 1810.

FIG. 19 illustrates a process in which the indoor unit 120 or the user device 1810 outputs the predicted amount of energy consumption reduction of the outdoor unit 110. However, it is also possible that the predicted amount of energy consumption reduction may be calculated by the injection device 10 or the server 1820 and may be output through the indoor unit 120 or the user device 1810.

In operation S1902, the indoor unit 120 or the user device 1810 may receive operation information of the injection device 100. The operation information of the injection device 100 may include at least one of whether or not the injection operation is being currently performed or information about a time period of the injection operation.

Also, in operation S1904, the indoor unit 120 or the user device 1810 may receive state information of the outdoor unit 110. The outdoor unit state information may include a fan PM or a compressor operating frequency.

The indoor unit 120 or the user device 1810 may cyclically perform an operation S1902 of receiving the operation information of the injection device 100 and an operation S1904 of receiving the outdoor unit state information. Also, the order of operation S1902 and operation S1904 is not limited to the order illustrated in FIG. 19. Operation S1902 and operation S1904 may be performed in parallel, or operation S1902 may be performed after operation S1904.

Next, in operation S1906, the indoor unit 120 or the user device 1810 may calculate information about the predicted amount of energy consumption reduction. The indoor unit 120 or the user device 1810 may calculate the information about the predicted amount of energy consumption reduction, based on the operation information of the injection device 100 and the outdoor unit state information. The operation of calculating the information about the predicted amount of energy consumption reduction will be described in detail below with reference to FIG. 20.

Next, in operation S1908, the indoor unit 120 or the user device 1810 may display the operation information of the injection device 100. For example, the indoor unit 120 or the user device 1810 may output information about whether or not the injection device 100 is in operation, an operation time period, whether or not water lacks, etc. Also, in operation S1910, the indoor unit 120 or the user device 1810 may output the information about the predicted amount of energy consumption reduction according to the injection device 100. The indoor unit 120 or the user device 1810 may output the operation information of the injection device or the information about the predicted amount of energy consumption reduction, according to user's selection.

According to an embodiment of the disclosure, it is also possible that the indoor unit 120 may calculate the information about the predicted amount of energy consumption reduction, and the user device 1810 may output the information about the predicted amount of energy consumption reduction. Also, according to an embodiment of the disclosure, it is also possible that the user device 1810 may calculate the information about the predicted amount of energy consumption reduction, and the indoor unit 120 may output the information about the predicted amount of energy consumption reduction.

Figure 20:
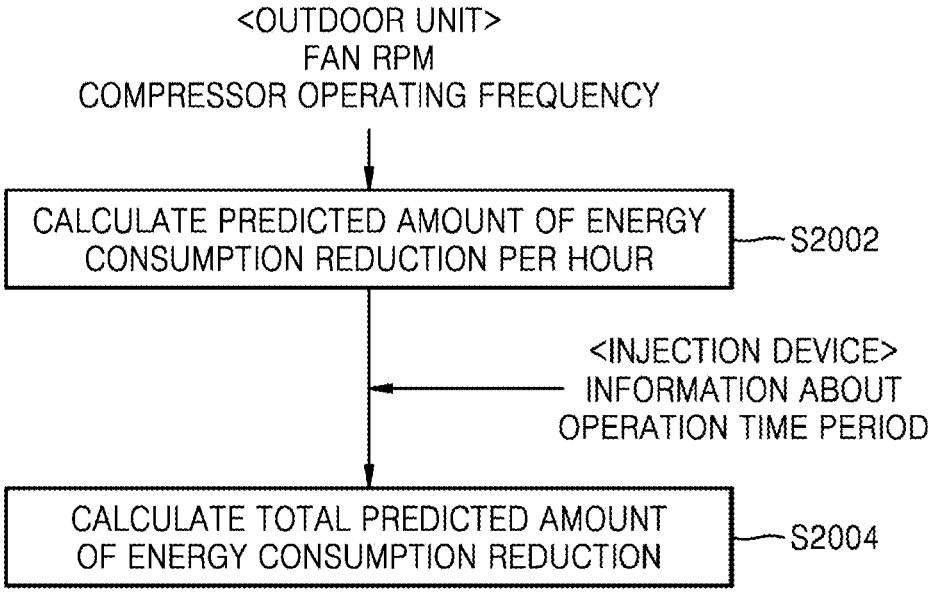
FIG. 20 is a diagram showing a process of calculating a predicted amount of energy consumption reduction, according to an embodiment of the disclosure.

FIG. 20 is a diagram showing a process of calculating the predicted amount of energy consumption reduction, according to an embodiment of the disclosure.

According to an embodiment of the disclosure, the injection device 100, the indoor unit 120, the user device 1810, or the server 1820 may calculate the predicted amount of energy consumption reduction by receiving outdoor unit state information and information about an operation time period of the injection device. With reference to FIG. 20, an example in which the injection device 100 calculates the predicted amount of energy consumption reduction is mainly described. However, it is for convenience of explanation, and an embodiment of the disclosure is not limited to the example in which the injection device 100 calculates the predicted amount of energy consumption reduction.

First, in operation S2002, the injection device 100 may calculate the predicted amount of energy consumption reduction per hour based on the outdoor unit state information. According to an embodiment of the disclosure, the injection device 100 may store a look-up table storing information about the predicted amount of energy consumption reduction per hour predefined according to a fan RPM and a compressor operating frequency of the outdoor unit 110. The injection device 100 may obtain the information about the predicted amount of energy consumption reduction per hour from the look-up table.

Next, in operation S2004, the injection device 100 may calculate the total predicted amount of energy consumption reduction by using the information about the operation time period of the injection device 100 and the information about the predicted amount of energy consumption reduction per hour. The injection device 100 may calculate the total predicted amount of energy consumption reduction by multiplying the information about the operation time period of the injection device 100 by the information about the predicted amount of energy consumption reduction per hour.

According to an embodiment of the disclosure, the injection device 100 may cyclically obtain the outdoor unit state information and the information about the operation time period of the injection device. Whenever the injection device 100 obtains the outdoor unit state information and the information about the operation time period of the injection device, the injection device 100 may calculate the total predicted amount of energy consumption reduction by adding, to the predicted amount of energy consumption reduction until a previous cycle, the predicted amount of energy consumption reduction of a current cycle. The predicted amount of energy consumption reduction of the current cycle may be calculated by performing operation S2002 and operation S2004. That is, the injection device 100 may calculate the predicted amount of energy consumption reduction per hour based on the outdoor unit state information and may multiply the predicted amount of energy consumption reduction per hour by an operation time period of the injection device of the current cycle. The injection device 100 may calculate the total predicted amount of energy consumption reduction by adding, to the predicted amount of energy consumption reduction until the previous cycle, the predicted amount of energy consumption reduction of the current cycle.

According to an embodiment of the disclosure, the injection device 100 may calculate the predicted amount of energy consumption reduction by accumulating the predicted amounts of energy consumption reduction, while the indoor unit 120 is turned on. The injection device 100 may reset the predicted amount of energy consumption reduction, when the indoor unit 120 is turned off. When the indoor unit 120 is turned on again, the injection device 100 may calculate the predicted amount of energy consumption reduction by accumulating the predicted amounts of energy consumption reduction from 0 again.

Figure 21:
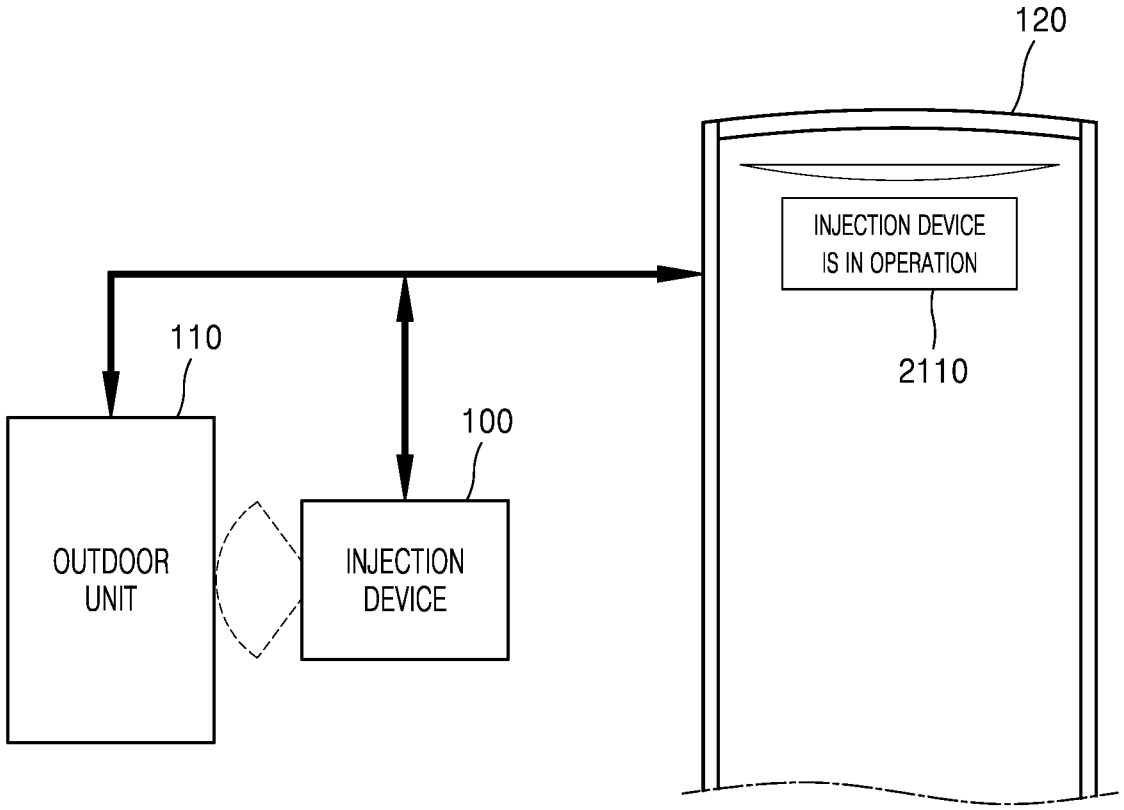
FIG. 21 is a diagram showing an operation of outputting operation information of an injection device on an indoor unit, according to an embodiment of the disclosure.

FIG. 21 is a diagram showing a process of outputting operation information of an injection device on an indoor unit, according to an embodiment of the disclosure.

According to an embodiment of the disclosure, the indoor unit 120 may receive operating information from the injection device 100 and may output the operation information. The indoor unit 120 may output the operation information of the injection device 100 through a display, a speaker, etc. For example, as illustrated in FIG. 21, the indoor unit 120 may display, on a display 2110, information that the injection device 100 is performing a water injection operation.

The injection device 100 may cyclically transmit the operation information through 485 communication. The indoor unit 120 may receive the operation information cyclically output by the injection device 100. The operation information of the injection device 100 may include at least one of whether or not an injection operation is being performed, the amount of water injection, the predicted amount of energy consumption reduction, an operation time period, the residual quantity of a water tank, or problem notification. The indoor unit 120 may output part or the whole of the operation information received from the injection device 100. For example, the indoor unit 120 may receive all types of injection device operation information transmitted from the injection device 100 and may display whether or not the injection operation is being performed and the predicted amount of energy consumption reduction from among the all types of injection device operation information. Also, the indoor unit 120 may display the problem notification, when the problem notification is received from the injection device 100.

Figure 22:
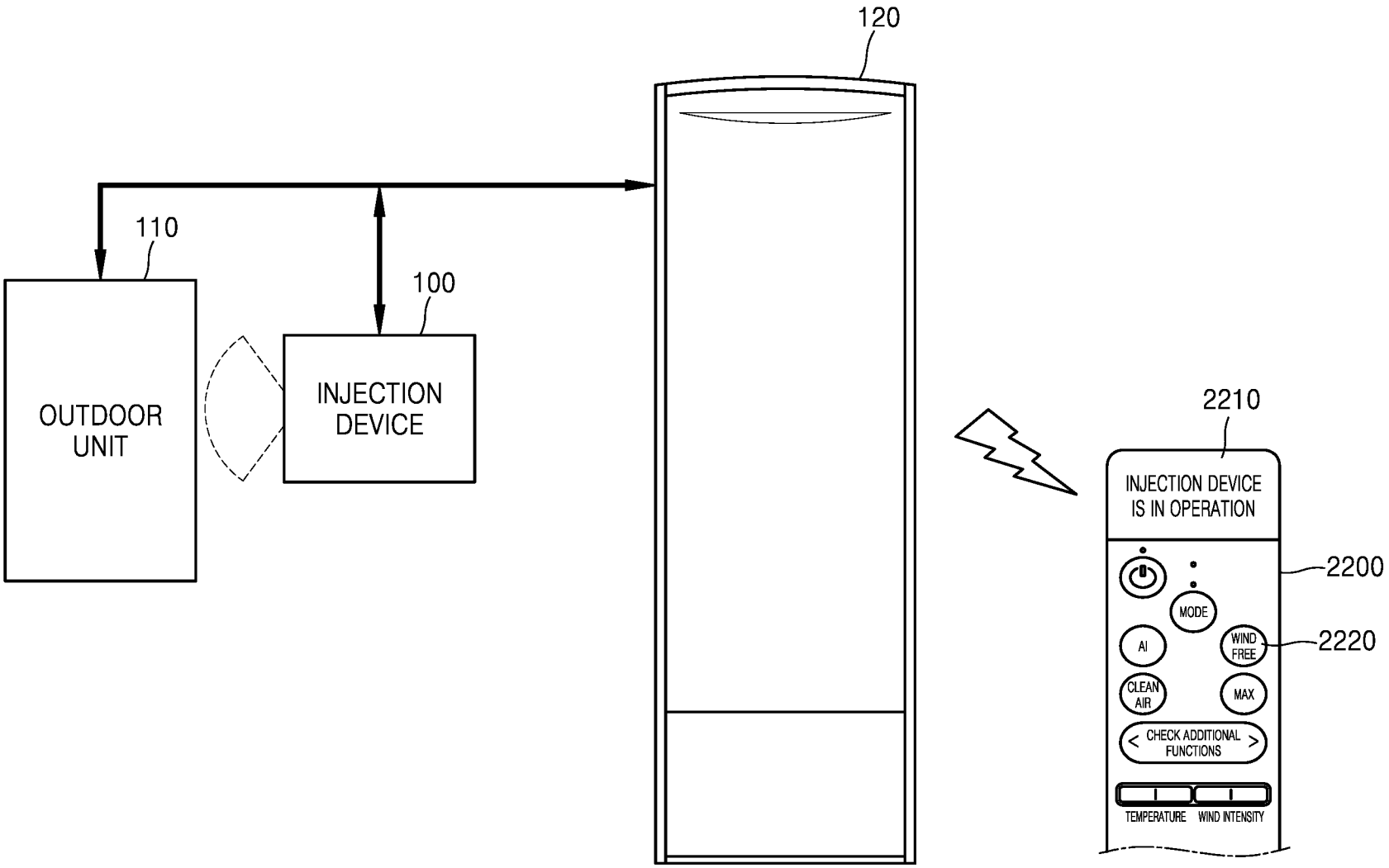
FIG. 22 is a diagram showing an operation of outputting operation information of an injection device through a remote controller of an air conditioner, according to an embodiment of the disclosure.

FIG. 22 is a diagram showing a process of outputting operation information of an injection device via a remote controller of an air conditioner, according to an embodiment of the disclosure.

According to an embodiment of the disclosure, the air conditioner 10 may include a remote controller 2200. The remote controller 2200 may wirelessly communicate with the indoor unit 120 and may receive a user input from a user and transmit the user input to the indoor unit 120. The remote controller 2200 may include a plurality of buttons 2220 for controlling an operation of the indoor unit 120. For example, the remote controller 220 may include a power button, a mode selection button, an air volume control button, a temperature setting button, an additional function selection button, a windless mode selection button, an artificial intelligence (AI) mode selection button, an air cleaning mode selection button, or the like. The remote controller 220 may include buttons of various combinations.

According to an embodiment of the disclosure, the remote controller 220 may include a display 2210. The remote controller 2200 may receive state information of the indoor unit 120 from the indoor unit 120 and display the state information of the indoor unit 120. For example, the remote controller 2200 may receive temperature setting information, air volume information, operation mode information, additional function setting information, or the like from the indoor unit 120 and display the received information on the display 2210.

According to an embodiment of the disclosure, the remote controller 2200 may receive operation information of the injection device 100 from the indoor unit 100 and display the operation information of the injection device 100. For example, the remote controller 2200 may display whether or not the injection device 100 is performing an injection operation and the predicted amount of energy consumption reduction. Also, when problem notification of the injection device 100 is received from the indoor unit 120, the remote controller 2200 may display the problem notification.

The indoor unit 120 may transmit, to the remote controller 2200, injection device operation information to be displayed through the remote controller 2200 from among a plurality of types of injection device operation information received from the injection device 100. For example, the indoor unit 120 may transmit, to the remote controller 2200, whether or not the injection operation is being performed, the predicted amount of energy consumption reduction, and the problem notification from among the types of injection device operation information.

FIG. 23 is a diagram showing an operation, performed by a user device, of outing operation information of an injection device, according to an embodiment of the disclosure.

According to an embodiment of the disclosure, the user device 1810 may receive operation information of the injection device 100 from the server 1820 and output the injection device operation information. The user device 1810 may output state information of the air conditioner 10 and may execute an application for controlling the air conditioner 10. The user device 1810 may output the injection device operation information through the application.

In operation 2310, the user device 1810 may display the operation information of the injection device 100. The user device 1810 may display information about whether or not the injection device 100 is performing a water injection operation, an operation mode of the air conditioner, the predicted amount of energy consumption reduction, the residual quantity of water of the water tank, etc.

In operation 2320, the user device 1810 may display an operation record of the injection device 100. The user device 1810 may receive, from the server 1820, log information including the operation record of the injection device 100 and may display the log information. The user device 1810 may display operation information per hour of the injection device 100. Operation information may include information about a power on/off state of the injection device 100, a power on/off state of the air conditioner, operation notification of the injection device, a change of an operation mode of the air conditioner, etc. The user device 1810 may display the injection device operation information and the air conditioner operation information together.

Figure 24:
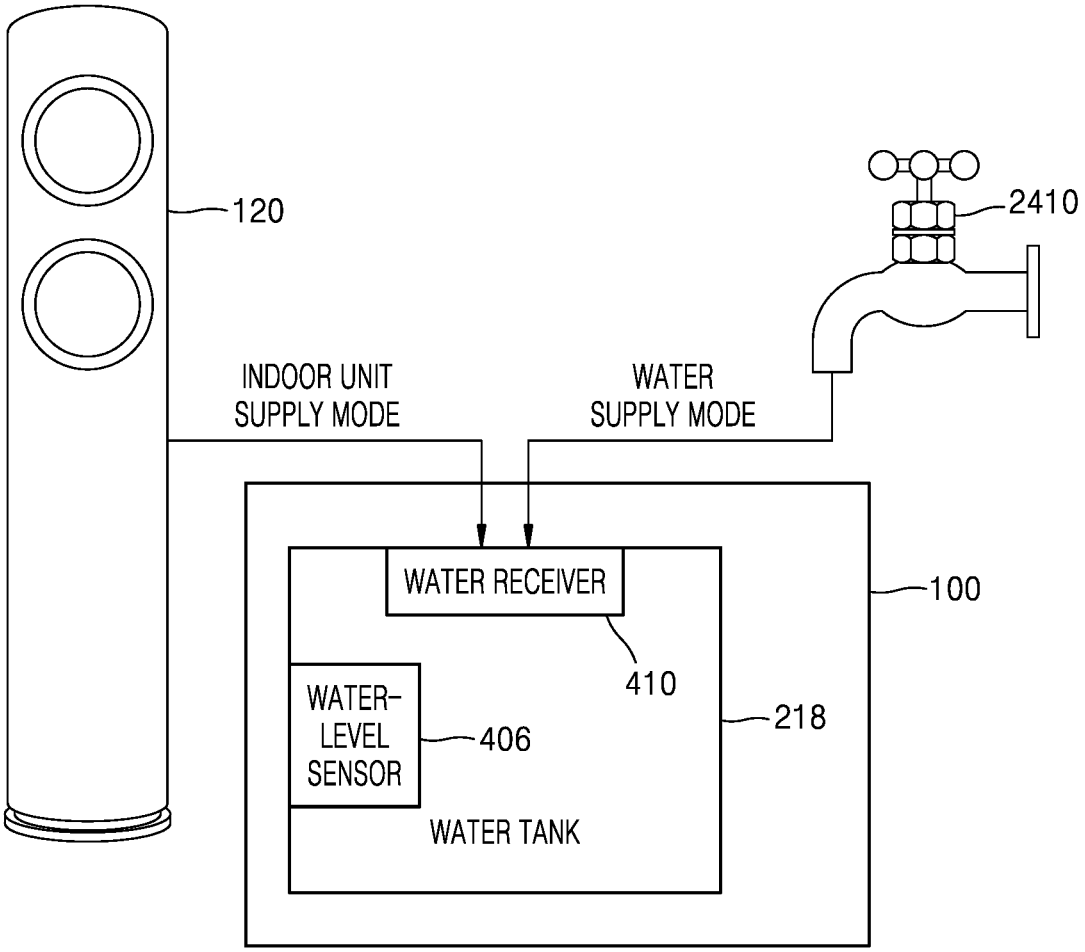
FIG. 24 is a diagram showing a configuration in which an injection device operates in an indoor unit supply mode or a water supply mode, according to an embodiment of the disclosure.

FIG. 24 is a diagram showing a configuration in which an injection device operates in an indoor unit supply mode or a water supply mode, according to an embodiment of the disclosure.

According to an embodiment of the disclosure, the water receiver 410 of the injection device 100 may be connected to the indoor unit 120 or a water supply 2410.

When the water receiver 410 of the injection device 100 is connected to the indoor unit 120, the injection device 100 may receive condensate water of the indoor unit 120. When the water receiver 410 is connected to the indoor unit 120, the injection device 100 may operate in an indoor unit supply mode.

When water receiver 410 of the injection device 100 is connected to the water supply 2410, the injection device 100 may receive water from the water supply 2410. When the water receiver 410 is connected to the water supply 2410, a predetermined water supply valve (not shown) may be provided between the water supply 2410 and the water receiver 410. The injection device 100 may receive water of the water supply 2410, or the water of the water supply 2410 may be blocked for the injection device 100, via the water supply valve. When the water receiver 410 is connected to the water supply 2410, the injection device 100 may operate in a water supply mode.

When the injection device 100 is mounted in the outdoor unit 110, the water receiver 410 may be connected to the indoor unit 120 or the water supply 2410. According to whether the water receiver 410 is connected to the indoor unit 120 or the water supply 2410, the injection device 100 may be set in the indoor unit supply mode or the water supply mode.

Figure 25:
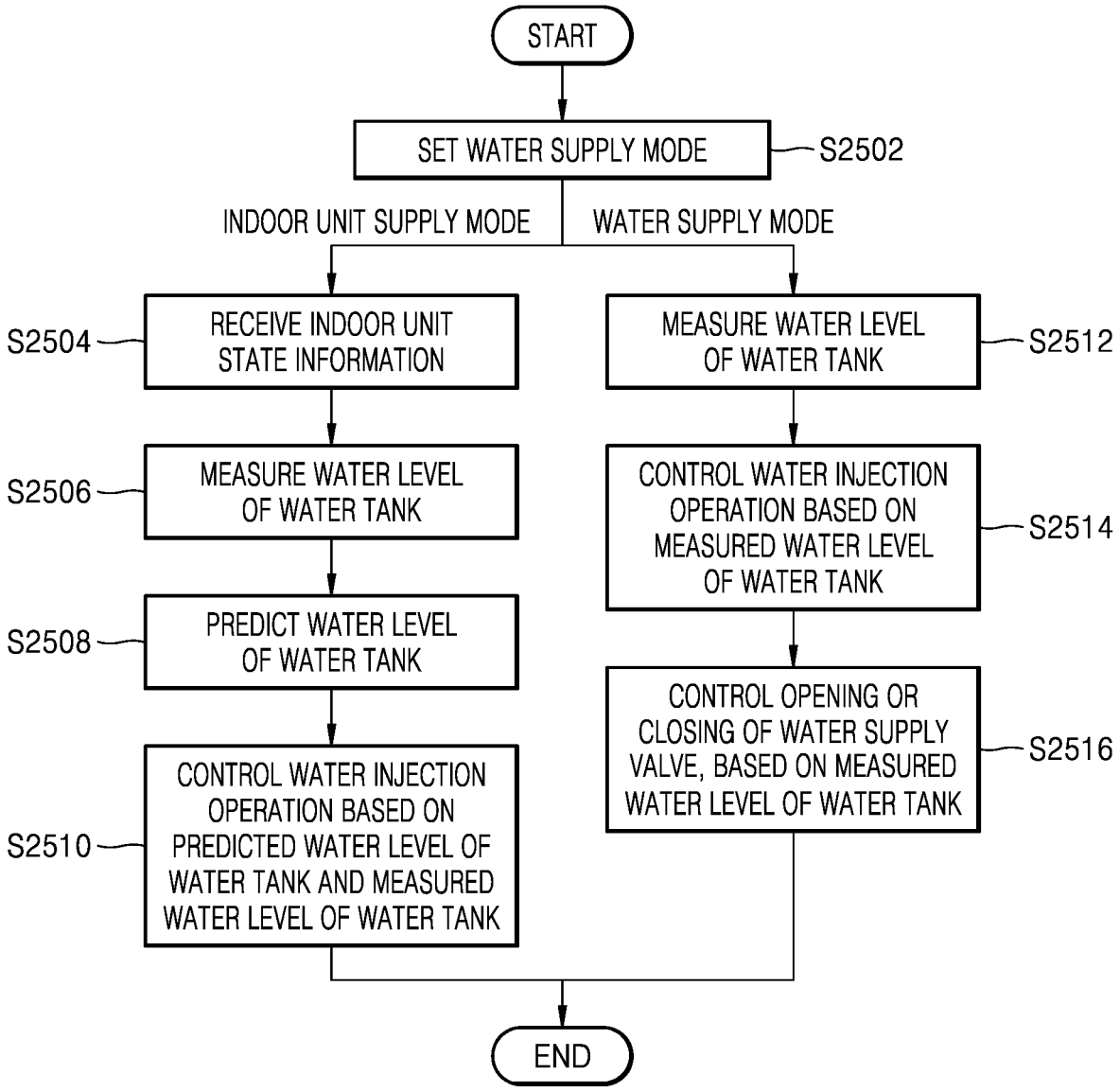
FIG. 25 is a flowchart showing a process in which an injection device operates in an indoor unit supply mode or a water supply mode, according to an embodiment of the disclosure.

FIG. 25 is a flowchart of a process in which an injection device operates in an indoor unit supply mode or a water supply mode, according to an embodiment of the disclosure.

In operation S2502, the injection device 100 may set a water supply mode, when the injection device 100 is initially mounted. When the injection device 100 receives condensate water from the indoor unit 120, the injection device 100 may be set in an indoor unit supply mode. When the injection device 100 receives water from the water supply 2410, the injection device 100 may be set in a water supply mode.

According to an embodiment of the disclosure, the injection device 100 may automatically set the water supply mode. For example, the injection device 100 may sense a type of a hose connected to the water receiver 410 and may set the water supply mode according to the type of the hose. Also, for example, according to whether or not a control terminal for controlling a water supply valve for opening or closing water of the water supply 2410 is connected to the injection device 100, the injection device 100 may set the water supply mode. When the control terminal for controlling the water supply valve for opening or closing the water of the water supply 2410 is sensed, the injection device 100 may set the water supply mode, and when the control terminal is not sensed, the injection device 100 may set the indoor unit supply mode. Also, for example, the water supply mode of the injection device 100 may be set according to a user input.

When the water supply mode is set as the indoor unit supply mode, the injection device 100 may obtain indoor unit state information in operation S2504. The injection device 100 may cyclically obtain the indoor unit state information.

Next, in operation S2506, the injection device 100 may measure a water level of the water tank. The injection device 100 may measure the water level of the water tank by using the water-level sensor 406.

Next, in operation S2508, the injection device 100 may predict a water level of the water tank, based on the indoor unit state information and the measured water level of the water tank. The injection device 100 may predict the amount of a condensate water supply per hour based on the indoor unit state information, as described above with reference to FIG. 17. Also, the injection device 100 may predict the amount of water consumption per hour based on the operation information of the injection device 100. The injection device 100 may predict the water level of the water tank according to time, based on a current water level of the water tank, the predicted amount of the condensate water supply per hour, and the predicted amount of water consumption per hour.

Next, in operation S2510, the injection device 100 may control a water injection operation based on the predicted water level of the water tank and the measured water level of the water tank.

When it is predicted that the predicted water level of the water tank is to decrease to be equal to or lower than a minimum reference water level within a reference time period, the injection device 100 may decrease the amount of water injection. Also, when it is predicted that the predicted water level of the water tank is to increase to be greater than a maximum reference water level within a reference time period, the injection device 100 may increase the amount of water injection.

Also, when a currently measured water level of the water tank is equal to or less than the minimum reference water level, the injection device 100 may decrease the amount of water injection. Also, when the measured water level of the water tank is equal to or less than the minimum reference water level, the injection device 100 may stop water injection and generate and output water shortfall notification. Also, when the currently measured water level of the water tank is equal to or greater than the maximum reference water level, the injection device 100 may increase the amount of water injection and generate and output water spilling notification.

When the water supply mode is set as the water supply mode, the injection device 100 may measure a water level of the water tank in operation S2512. The injection device 100 may control a water injection operation based on the measured water level of the water tank. When a currently measured water level of the water tank is equal to or less than a minimum reference water level, the injection device 100 may decrease the amount of water injection. When the measured water level of the water tank is equal to or less than the minimum reference water level, the injection device 100 may stop water injection and generate and output water shortfall notification.

Next, in operation S2516, the injection device 100 may control opening or closing of the water supply valve based on the measured water level of the water tank. When the currently measured water level of the water tank is equal to or greater than a maximum reference water level, the injection device 100 may close the water supply valve. When the currently measured water level of the water tank decreases to be less than the maximum reference water level, the injection device 100 may open the water supply valve again.

Figure 26:
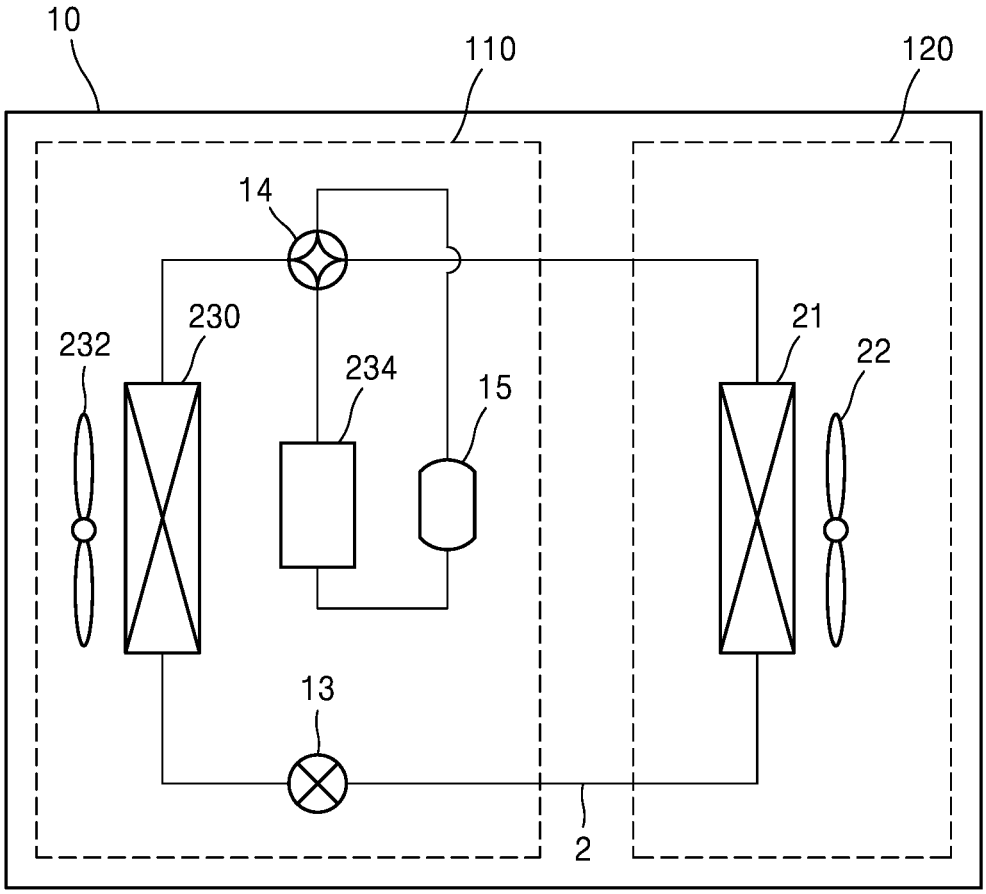
FIG. 26 is a schematic diagram showing components of an air conditioner according to an embodiment of the disclosure.
Figure 27:
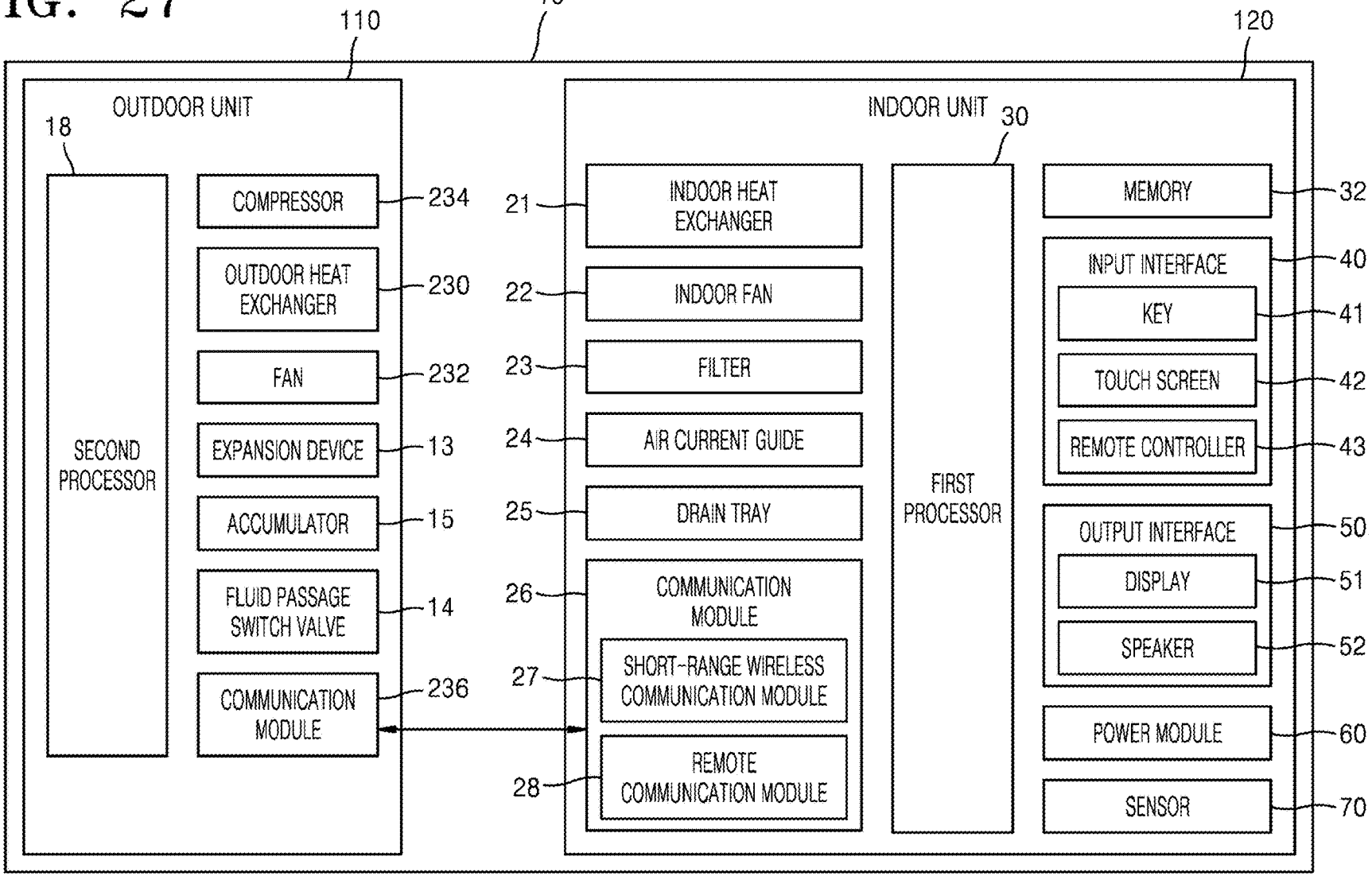
FIG. 27 is a schematic block diagram showing components of an air conditioner according to an embodiment of the disclosure.

FIG. 26 is a schematic diagram showing components of the air conditioner 10 according to an embodiment of the disclosure. FIG. 27 is a schematic block diagram showing the components of the air conditioner 10 according to an embodiment of the disclosure.

Referring to FIGS. 26 and 27, the air conditioner 10 may include the compressor 234, the outdoor heat exchanger 230, an expansion device 13, an indoor heat exchanger 21, and a refrigerant pipe 2. The refrigerant pipe 2 may connect the compressor 234, the outdoor heat exchanger 230, the expansion device 13, and the indoor heat exchanger 21.

The outdoor unit 110 and may be fluidally connected to the indoor unit 120 through the refrigerant pipe 2. Through the refrigerant pipe 2, a refrigerant may be circulated between the outdoor unit 110 and the indoor unit 120. The refrigerant may be circulated through the refrigerant pipe 2 in the order of the compressor 234, the outdoor heat exchanger 230, the expansion device 13, and the indoor heat exchanger 21 or in the order of the compressor 234, the indoor heat exchanger 21, the expansion device 13, and the outdoor heat exchanger 230.

The compressor 234, the outdoor heat exchanger 230, and the expansion device 13 may be arranged in the outdoor unit 110. The indoor heat exchanger 21 may be mounted in the indoor unit 120. However, the structures of the indoor unit 110 and the outdoor unit 120 are not limited thereto and may vary. For example, the position of the expansion device 13 is not limited to the outdoor unit 110 and may be arranged in the indoor unit 120 according to necessity.

The compressor 234 may condense a refrigerant gas. During the condensation of the refrigerant gas by the compressor 234, the refrigerant gas may be transformed from a low temperature/low pressure state to a high temperature/high pressure state.

The air conditioner 10 may further include a fluid passage switch valve 14. The fluid passage switch valve 14 may include, for example, a 4-way valve. The fluid passage switch valve 14 may switch the circulation path of the refrigerant depending on an operation mode (for example, a cooling operation or a heating operation) of the air conditioner 10. The fluid passage switch valve 14 may be connected to a discharger through which the refrigerant gas is discharged from the compressor 234.

The air conditioner 10 may include an accumulator 15. The accumulator 15 may be connected to a suction portion through which the refrigerant gas is suck from the compressor 234. A low temperature/low pressure refrigerant expanded from the indoor heat exchanger 21 or the outdoor heat exchanger 230 may be introduced into the accumulator 15. The accumulator 15 may separate a refrigerant liquid from the refrigerant gas when the refrigerant in which the refrigerant liquid and the refrigerant gas are mixed is introduced into the accumulator 15 and may provide the refrigerant gas from which the refrigerant liquid is separated to the compressor 234.

The outdoor heat exchanger 230 may perform a heat exchange between the refrigerant and outdoor air. For example, during a cooling operation, a high pressure/high temperature refrigerant may be condensed in the outdoor heat exchanger 230, and while the refrigerant is condensed, the refrigerant may discharge heat to the outdoor air. During a heating operation, a low temperature/low pressure refrigerant may be expanded in the outdoor heat exchanger 230, and while the refrigerant is expanded, the refrigerant may absorb heat from the outdoor air.

The fan 232 may be provided in the vicinity of the outdoor heat exchanger 230. The fan 232 may pass the outdoor air to the outdoor heat exchanger 230 to facilitate the heat exchange between the refrigerant and the outdoor air.

The expansion device 13 may decrease the pressure and the temperature of the refrigerant condensed in the outdoor heat exchanger 230 during the cooling operation and may decrease the pressure and the temperature of the refrigerant condensed in the indoor heat exchanger 21 during the heating operation.

The expansion device 13 may decrease the temperature and the pressure of the refrigerant by using, for example, a throttle effect. The expansion device 13 may include an orifice which may reduce a cross-sectional area of the fluid passage. The refrigerant having passed through the orifice may have the reduced temperature and pressure.

The expansion device 13 may be implemented, for example, as an electronic expansion valve which may control an open ratio (a ratio of the cross-sectional area of the fluid passage of the valve in a partially open state to the cross-sectional area of the fluid passage of the valve in a completely open state). Depending on the open ratio of the electronic expansion valve, the amount of the refrigerant passing through the expansion device 13 may be controlled.

The indoor heat exchanger 21 may perform a heat exchange between the refrigerant and indoor air. During a cooling operation, a low temperature/low pressure refrigerant may be expanded in the indoor heat exchanger 21, and while the refrigerant is expanded, the refrigerant may absorb heat from the indoor air. During a heating operation, a high pressure/high temperature refrigerant may be condensed in the indoor heat exchanger 21, and while the refrigerant is condensed, the refrigerant may discharge heat to the indoor air.

An indoor fan 22 may be provided in the vicinity of the indoor heat exchanger 21. The indoor fan 22 may pass the indoor air to the indoor heat exchanger 21 to facilitate the heat exchange between the refrigerant and the indoor air. The indoor fan 22 may have various forms. For example, the indoor fan 22 may include at least one of an axial fan, a mixed flow fan, a cross-flow fan, or a centrifugal fan.

The indoor unit 120 according to an embodiment of the disclosure may further include a filter 23, an air current guide 24, and a drain tray 25. The filter 23 may filter out impurities of the air introduced into the indoor unit 120. The air current guide 24 may guide a direction of the air discharged from the indoor unit 120. The drain tray may collect the condensate water generated in the indoor heat exchanger 21. The condensate water accommodated in the drain tray 25 may be discharged to the outside through a discharge hose.

The indoor unit 120 may further include a communication module 26, a first processor 30, a memory 32, an input interface 40, an output interface 50, a power supply module 60, and a sensor 70.

The first processor 30 may control general operations of the air conditioner 10. The first processor 30 may control components of the air conditioner 10 by executing a program stored in the memory 32. The first processor 30 may include an additional neural processing unit (NPU) performing an operation of an AI model. Also, the first processor 30 may include a CPU, a graphics processing unit (GPU), etc.

The memory 32 may store or record various information, data, instructions, programs, etc. required for operations of the air conditioner 10. The memory 32 may remember temporary data occurring during generation of control signals for controlling the components included in the air conditioner 10. The memory 32 may include at least one of a volatile memory or a non-volatile memory or a combination thereof.

The first processor 30 and the memory 32 may be integrally provided and separately provided. The first processor 30 may include one or more processors. For example, the first processor 30 may include a main processor and at least one sub-processor. The memory 32 may include one or more memories.

The communication module 26 may include at least one of a short-range wireless communication module 27 or a remote communication module 28. The communication module 26 may include at least one antenna for wirelessly communicating with another device. The communication module 26 may wirelessly communicate with a remote controller 43.

The short-range wireless communication module 27 may include a Bluetooth communication module, a BLE communication module, an NFC module, a WLAN (or Wifi) communication module, a Zigbee communication module, an IrDA communication module, a WFD communication module, a UWB communication module, an Ant+ communication module, a microwave (μWave) communication module, etc. but is not limited thereto.

The remote communication module 28 may include communication modules for performing various types of remote communication and may include a mobile communicator. The mobile communicator may transceive a wireless signal with at least one of a base station, an external terminal, or a server on a mobile communication network.

The communication module 26 may communicate with an external device, such as a server, a mobile device, another home appliance device, etc., through a peripheral AP. The AP may connect a LAN to which the air conditioner 10 or a user device are connected to a WAN to which a server is connected. The air conditioner 10 or the user device may be connected to the server through the WAN.

The input interface 40 may include a key 41, a touch screen 42, the remote controller 43, etc. The input interface 40 may receive a user input and transmit the user input to the first processor 30.

The output interface 50 may include a display 51, a speaker 52, etc. The output interface 50 may output various notifications, messages, information, etc. generated by the first processor 30.

The power supply module 60 may be connected to a power unit and may provide a power supply to the components of the air conditioner 10.

The sensor 70 may include a temperature sensor, a humidity sensor, an illuminance sensor, etc. The first processor 30 may determine a wind intensity or an operation mode (cooling, heating, wind passing, etc.) based on a detection value of the sensor 70 and may control the indoor heat exchanger 21, the indoor fan 22, or the outdoor unit 110.

The outdoor unit 110 may further include a communication module 236 and a second processor 18.

The second processor 18 may control generation operations of the components of the outdoor unit 110. The second processor 18 may receive a control signal from the first processor 30 of the indoor unit 120 through the communication module 236 and may control operations of the outdoor unit 110. The second processor 18 may control, based on the control signal of the first processor 30, the operation of the compressor 234, the outdoor heat exchanger 230, the expansion device 13, the fluid passage switch valve 14, the accumulator 15, or the fan 232.

The communication module 236 may communicate with the communication module 26 of the indoor unit 120. The communication module 236 may perform wired or wireless communication.

Machine-readable storage media may be provided as non-transitory storage media. Here, the term "non-transitory storage media" only denotes that the media are tangible devices, rather than signals (e.g., electromagnetic waves), and does not distinguish the storage media semi-permanently storing data and the storage media temporarily storing data. For example, the "non-transitory storage medium" may include a buffer temporarily storing data.

According to an embodiment of the disclosure, the method according to various embodiments disclosed in the present specification may be provided as an inclusion of a computer program product. The computer program product may be, as a product, transacted between a seller and a purchaser. The computer program product may be distributed in the form of a machine-readable storage medium (e.g., a compact disc (CD)-ROM) or may be distributed directly between two user devices (e.g., smartphones) or online (e.g., downloaded or uploaded) through an application store. In the case of the online distribution, at least part of the computer program product (e.g., a downloadable application) may be at least temporarily stored in a machine-readable storage medium, such as a server of a manufacturer, a server of an application store, or a memory of a relay server, or may be temporarily generated.

According to an embodiment of the disclosure, an air conditioner including an outdoor unit is provided. The outdoor unit comprises an outdoor heat exchanger and an injection device which injects water to the outdoor unit. Also, the injection device comprises a water tank configured to store water. Also, the injection device comprises a nozzle configured to inject the water stored in the water tank to the outdoor heat exchanger. Also, the injection device comprises a communication interface. Also, the injection device comprises a memory storing at least one instruction. Also, the injection device comprises at least one processor configured to execute the at least one instruction to: obtain state information of the outdoor unit, wherein the obtained state information includes at least one of compressor operating frequency information or fan revolution per minute (RPM) information of the outdoor unit, and control a water injection operation of the nozzle to inject water to the outdoor heat exchanger, in accordance with the at least one of the compressor operating frequency information or the fan revolution per minute (RPM) information of the outdoor unit included in the obtained state information.

Also, according to an embodiment of the disclosure, the at least one processor (210) may further be configured to execute the at least one instruction to: receive state information of an indoor unit (120) of the air conditioner (10) through the communication interface (212); and control the water injection operation of the nozzle (216) based on the received state information of the outdoor unit (110) and the received state information of the indoor unit (120).

Also, according to an embodiment of the disclosure, the outdoor unit (110) may further include a water-level sensor (406) configured to measure a water level of water stored in the water tank (218). The received state information of the indoor unit (120) may include at least one of indoor temperature information, target temperature information, or an amount of indoor dehumidification. The at least one processor (210) may further be configured to execute the at least one instruction to: predict, based on the at least one of the indoor temperature information, the target temperature information, or the amount of indoor dehumidification included in the received state information of the indoor unit (120), an amount of a condensate water supply per hour; predict, based on the measured water level of the water stored in the water tank and the amount of the condensate water supply per hour, a change in the water level of the water tank (218); and control, based on the predicted change in the water level of the water stored in the water tank (218), the water injection operation of the nozzle (216).

Also, according to an embodiment of the disclosure, the at least one processor (210) may further be configured to execute the at least one instruction to, in the cased that the indoor unit (120) is provided as a plurality of indoor units, predict, with respect to each indoor unit (120) of the plurality of indoor units (120), an individual amount of a condensate water supply per hour, based on the at least one of the indoor temperature information, the target temperature information, or the amount of indoor dehumidification included in the received state information of the indoor unit, and identify the amount of the condensate water supply per hour by adding the predicted individual amount of the condensate water supply per hour with respect to each indoor unit (120) of the plurality of indoor units (120).

Also, according to an embodiment of the disclosure, the injection device (100) may further include the water-level sensor (406) configured to measure a water level of water stored in the water tank (218), and the at least one processor (210) may further be configured to execute the at least one instruction to control the water injection operation of the nozzle (216) based on the measured water level of water stored in the water tank (218).

Also, according to an embodiment of the disclosure, the at least one processor (210) may further be configured to execute the at least one instruction to control the water injection operation of the nozzle (216) by controlling a water injection time period or a water injection cycle of the nozzle (216).

Also, according to an embodiment of the disclosure, the water tank (218) may include a water receiver (410) through which condensate water of the indoor unit (120) of the air conditioner (10) is received.

Also, according to an embodiment of the disclosure, the obtained state information of the injection device (100) may further include at least one of outdoor temperature information or outdoor unit size information. Also, the at least one processor may further be configured to execute the at least one instruction to control the water injection operation of the nozzle (216) based on the at least one of the outdoor temperature information or the outdoor unit size information included in the obtained state information of the outdoor unit.

Also, according to an embodiment of the disclosure, the outdoor unit (110) may further include a step motor (442) configured to rotate the nozzle (216), and the at least one processor (210) may further be configured to execute the at least one instruction to: obtain size information of the outdoor unit (110); determine a rotation angle of the nozzle (216) based on the obtained size information of the outdoor unit (110); and control the step motor (442) to rotate the nozzle (216) according to the determined rotation angle of the nozzle (216).

Also, according to an embodiment of the disclosure, the at least one processor (210) may further be configured to execute the at least one instruction to: obtain information about whether or not a compressor (234) of the outdoor unit (110) is in operation; and, when the obtained information indicates that the compressor (234) of the outdoor unit (110) is in operation, perform the water injection operation.

Also, according to an embodiment of the disclosure, the at least one processor (210) may further be configured to execute the at least one instruction to transmit, through the communication interface (212), to an indoor unit (120) of the air conditioner (10), operation information of the outdoor unit (110).

Also, according to an embodiment of the disclosure, the at least one processor (210) may further be configured to execute the at least one instruction to: calculate a predicted amount of energy consumption reduction according to the water injection operation; and transmit, through the communication interface (212), to an indoor unit (120) of the air conditioner (10), information about the predicted amount of energy consumption reduction.

Also, according to an embodiment of the disclosure, the at least one processor (210) may further be configured to execute the at least one instruction to obtain, based on the fan revolutions per minute (RPM) of the outdoor unit (110) and the compressor operating frequency of the outdoor unit (110), the information about the predicted amount of energy consumption reduction, from a stored look-up table.

Also, according to an embodiment of the disclosure, the injection device (100) may further include a water-level sensor (406) configured to measure a water level of water stored in the water tank (218), and the at least one processor (210) may further be configured to execute the at least one instruction to: operate in an indoor unit supply mode in which condensate water of an indoor unit (120) of the air conditioner (10) is supplied to the water tank (218) or a water supply mode in which the water tank is connected to a water supply; when the at least one processor (210) operates in the indoor unit supply mode, receive indoor unit state information from the indoor unit (120) through the communication interface (212), predict, based on the received indoor unit state information, the water level of the water stored in the water tank, and control, based on the predicted water level of the water stored in the water tank and the water level of the water stored in the water tank measured by the water-level sensor (406), the water injection operation of the nozzle (216); and when the processor operates in the water supply mode, control, based on the water level of the water stored in the water tank measured by the water-level sensor (406), opening and closing of a water supply valve to control a water supply to the water tank, and control, based on the measured water level of the water stored in the water tank measured by the water-level sensor (406), the water injection operation of the nozzle (216).

Also, according to an embodiment of the disclosure, the injection device may be detachably arranged outside the outdoor unit and is arranged to inject water to the outdoor heat exchanger by using the nozzle.

Also, according to an embodiment of the disclosure, the injection device may be in the outdoor unit and is arranged to inject water to the outdoor heat exchanger by using the nozzle.

Also, according to an embodiment of the disclosure, there is provided a controlling method for an air conditioner including an outdoor unit. The controlling method comprises obtaining state information of the outdoor unit, wherein the obtained state information includes at least one of compressor operating frequency information or fan revolution per minute (RPM) information of the outdoor unit. Also, the controlling method comprises controlling, in accordance with the at least one of the compressor operating frequency information or the fan revolution per minute (RPM) information of the outdoor unit included in the obtained state information, a water injection operation, performed by a nozzle of the outdoor unit, of injecting water stored in a water tank of the outdoor unit to an outdoor heat exchanger.

Also, according to an embodiment of the disclosure, the controlling method may further comprise receiving state information of an indoor unit of the air conditioner, and controlling the water injection operation of the nozzle based on the received state information of the indoor unit.

Also, according to an embodiment of the disclosure, there is provided a computer-readable recording medium having recorded thereon a program for executing, on a computer, a controlling method for an air conditioner.

Also, according to an embodiment of the disclosure, there is provided a controlling method for an electronic device. The controlling method comprises receiving, from an outdoor unit configured to inject water to an outdoor heat exchanger, operation information of the outdoor unit. Also, the controlling method comprises receiving state information of the outdoor unit. Also, the controlling method comprises calculating, based on the received operation information of the outdoor unit and the received state information of the outdoor unit, information about an amount of energy consumption reduction according to the outdoor unit. Also, the controlling method comprises displaying the received operation information of the outdoor unit. Also, the controlling method comprises displaying the calculated information about the amount of energy consumption reduction according to the outdoor unit.

Also, according to an embodiment of the disclosure, the received operation information of the outdoor unit may include at least one of information about whether or not the outdoor unit is in operation or information about a water level of water stored in a water tank of the outdoor unit. Also, the received state information of the outdoor unit may include a fan revolution per minute (RPM) and a compressor operating frequency of the outdoor unit. Also, the calculating of the information about the amount of energy consumption reduction may include obtaining, in accordance with the fan RPM and the compressor operating frequency of the outdoor unit included in the received state information of the outdoor unit, information about an amount of energy consumption reduction per hour, by using a look-up table, and calculating the information about the amount of energy consumption reduction in accordance with an operation time period of the outdoor unit and the obtained information about the amount of energy consumption reduction per hour.

The invention claimed is:

1. An air conditioner comprising:
- an outdoor unit comprising:
  - an outdoor heat exchanger; and
- an injection device configured to inject water to the outdoor unit, the injection device including:
  - a water tank configured to store water,
  - a nozzle configured to inject the water stored in the water tank to the outdoor heat exchanger,
  - a communication interface,
  - a memory storing at least one instruction, and
  - at least one processor configured to execute the at least one instruction to:
    - obtain, through the communication interface, state information transmitted by the outdoor unit, wherein the obtained state information includes compressor operating frequency of the outdoor unit, and
    - control a water injection operation of the nozzle to inject water stored in the water tank to the outdoor heat exchanger, in accordance with the compressor operating frequency of the outdoor unit included in the obtained state information, such that
      - as the compressor operating frequency of the outdoor unit increases, the injection device increases a water injection time period or decreases a water injection cycle to increase an amount of water injection, and,
      - as the compressor operating frequency of the outdoor unit decreases, the injection device decreases the water injection time period or increases the water injection cycle to decrease the amount of water injection.

2. The air conditioner of claim 1, wherein the at least one processor is further configured to execute the at least one instruction to:
- obtain state information of an indoor unit of the air conditioner through the communication interface, and control the water injection operation of the nozzle in accordance with the obtained state information of the outdoor unit and the obtained state information of the indoor unit.

3. The air conditioner of claim 2, further comprising:

a water-level sensor configured to measure a water level of water stored in the water tank, wherein the obtained state information of the indoor unit includes at least one of indoor temperature information, target temperature information, or an amount of indoor dehumidification, and the at least one processor is further configured to execute the at least one instruction to:

predict, in accordance with the at least one of the indoor temperature information, the target temperature information, or the amount of indoor dehumidification included in the obtained state information of the indoor unit, an amount of a condensate water supply per hour, predict, in accordance with the measured water level of the water stored in the water tank and the predicted amount of the condensate water supply per hour, a change in the water level of the water stored in the water tank, and control, in accordance with the predicted change in the water level of the water stored in the water tank, the water injection operation of the nozzle.

4. The air conditioner of claim 3, wherein the at least one processor is further configured to execute the at least one instruction to:

in a case that the indoor unit is provided as a plurality of indoor units, predict, with respect to each indoor unit of the plurality of indoor units, an individual amount of a condensate water supply per hour, in accordance with the at least one of the indoor temperature information, the target temperature information, or the amount of indoor dehumidification included in the obtained state information of the indoor unit, and identify the amount of the condensate water supply per hour by adding the predicted individual amount of the condensate water supply per hour with respect to each indoor unit of the plurality of indoor units.

5. The air conditioner of claim 1, wherein the injection device further includes a water-level sensor configured to measure a water level of water stored in the water tank, and the at least one processor is further configured to execute the at least one instruction to control the water injection operation of the nozzle in accordance with the measured water level of water stored in the water tank.

6. The air conditioner of claim 1, wherein the water tank includes a water receiver through which condensate water of an indoor unit of the air conditioner is received.

7. The air conditioner of claim 1, wherein the obtained state information of the outdoor unit further includes at least one of outdoor temperature information or outdoor unit size information, and the at least one processor is further configured to execute the at least one instruction to control the water injection operation of the nozzle in accordance with the at least one of the outdoor temperature information or the outdoor unit size information included in the obtained state information of the outdoor unit.

8. The air conditioner of claim 1, wherein the injection device further includes a step motor configured to rotate the nozzle, and the at least one processor is further configured to execute the at least one instruction to:

obtain size information of the outdoor unit, determine a rotation angle of the nozzle in accordance with the obtained size information of the outdoor unit, and control the step motor to rotate the nozzle in accordance with the determined rotation angle of the nozzle.

9. The air conditioner of claim 1, wherein the at least one processor is further configured to execute the at least one instruction to:

obtain information about whether or not a compressor of the outdoor unit is in operation, and, when the obtained information indicates that the compressor of the outdoor unit is in operation, perform the water injection operation.

10. The air conditioner of claim 1, wherein the at least one processor is further configured to execute the at least one instruction to transmit, through the communication interface, to an indoor unit of the air conditioner, operation information of the outdoor unit.

11. The air conditioner of claim 1, wherein the at least one processor is further configured to execute the at least one instruction to:

calculate a predicted amount of energy consumption reduction in accordance with the water injection operation, and transmit, through the communication interface, to an indoor unit of the air conditioner, information about the predicted amount of energy consumption reduction.

12. The air conditioner of claim 11, wherein the state information transmitted by the outdoor unit includes the compressor operating frequency and fan revolution per minute (RPM) of the outdoor unit, and the at least one processor is further configured to execute the at least one instruction to:

obtain, in accordance with the compressor operating frequency and the fan RPM of the outdoor unit, the information about the predicted amount of energy consumption reduction, from a stored look-up table.

13. The air conditioner of claim 1, wherein the injection device further includes a water-level sensor configured to measure a water level of water stored in the water tank, and the at least one processor is further configured to execute the at least one instruction to:

operate in an indoor unit supply mode in which condensate water of an indoor unit of the air conditioner is supplied to the water tank or a water supply mode in which the water tank is connected to a water supply via a water supply valve to receive water from the water supply, when the at least one processor operates in the indoor unit supply mode, obtain indoor unit state information from the indoor unit through the communication interface, predict, in accordance with the obtained indoor unit state information, the water level of the water stored in the water tank, and control, in accordance with the predicted water level of the water stored in the water tank and the water level of water stored in the water tank measured by the water-level sensor, the water injection operation of the nozzle, and when the at least one processor operates in the water supply mode, control, in accordance with the water level of water stored in the water tank measured by the water-level sensor, opening and closing of the water supply valve to control water supplied to the water tank, and control, in accordance with the water level of water stored in the water tank measured by the water-level sensor, the water injection operation of the nozzle.

14. The air conditioner of claim 1, wherein the injection device is outside of the outdoor unit.

15. The air conditioner of claim 1, wherein the injection device is in the outdoor unit.

16. A controlling method of an air conditioner including an outdoor unit, the controlling method comprising:

obtaining state information transmitted by the outdoor unit, wherein the state information includes at least one of compressor operating frequency of the outdoor unit; and controlling, in accordance with the compressor operating frequency of the outdoor unit included in the obtained state information, a water injection operation, performed by a nozzle of the outdoor unit, of injecting water stored in a water tank of the outdoor unit to an outdoor heat exchanger of the outdoor unit, wherein the controlling the water injection operation comprises:

as the compressor operating frequency of the outdoor unit increases, increasing a water injection time period or decreasing a water injection cycle to increase an amount of water injection, and, as the compressor operating frequency of the outdoor unit decreases, decreasing the water injection time period or increasing the water injection cycle to decrease the amount of water injection.

17. The controlling method of claim 16, further comprising:

obtaining state information of an indoor unit of the air conditioner; and controlling the water injection operation of the nozzle based on the obtained state information of the indoor unit.

18. The controlling method of claim 16, further comprising:

transmitting, by the outdoor unit, operation information of the outdoor unit to an electronic device;

wherein the electronic device performs:

obtaining the operation information transmitted by the outdoor unit;

obtaining state information of the outdoor unit;

calculating, based on the obtained operation information and the obtained state information of the outdoor unit, information about an amount of energy consumption reduction according to the outdoor unit;

displaying the obtained operation information; and displaying the calculated information about the amount of energy consumption reduction according to the outdoor unit.

19. The controlling method of claim 18, wherein the obtained operation information includes at least one of information about whether or not the outdoor unit is in operation or information about a water level of water stored in the water tank of the outdoor unit, the obtained state information of the outdoor unit includes the compressor operating frequency and fan revolution per minute (RPM) of the outdoor unit, and the calculating of the information about the amount of energy consumption reduction includes:

obtaining, in accordance with the compressor operating frequency and the fan RPM of the outdoor unit included in the obtained state information of the outdoor unit, information about an amount of energy consumption reduction per hour, by using a look-up table, and calculating the information about the amount of energy consumption reduction in accordance with an operation time period of the outdoor unit and the obtained information about the amount of energy consumption reduction per hour.

* * * * *